US012419440B1

(12) United States Patent
Bickel et al.

(10) Patent No.: US 12,419,440 B1
(45) Date of Patent: Sep. 23, 2025

(54) TRAVEL NURSERY APPARATUS

(71) Applicant: Regalo International, LLC, Burnsville, MN (US)

(72) Inventors: Shannon R. Bickel, Lakeville, MN (US); Heidi C. Leighton, Shorewood, MN (US); Kasey L. Pipo, Elko New Market, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 18/444,710

(22) Filed: Feb. 18, 2024

Related U.S. Application Data

(63) Continuation of application No. 17/229,821, filed on Apr. 13, 2021, now Pat. No. 11,903,495.

(60) Provisional application No. 63/012,749, filed on Apr. 20, 2020.

(51) Int. Cl.
*A47D 9/00* (2006.01)
*A47D 13/06* (2006.01)

(52) U.S. Cl.
CPC ..... *A47D 9/005* (2013.01); *A47D 13/061* (2013.01)

(58) Field of Classification Search
CPC . A47D 9/00; A47D 9/005; A47D 7/00; A47D 7/002; A47D 13/061
See application file for complete search history.

(56) References Cited

U.S. PATENT DOCUMENTS 1,950,603 A * 3/1934 Fischer ..... A47D 13/065 256/25
3,838,883 A * 10/1974 Machen ..... A47D 7/002 297/16.2
4,651,367 A * 3/1987 Osher ..... A47D 7/002 5/99.1
4,739,527 A * 4/1988 Kohus ..... A47D 13/066 5/99.1
5,115,524 A * 5/1992 Antosko ..... A47D 9/005 229/117.17
6,134,727 A * 10/2000 Hwang ..... A47C 17/64 5/112
6,421,850 B1 * 7/2002 Welsh, Jr. ..... A47D 13/063 5/98.1
6,438,773 B1 * 8/2002 Hsia ..... A47D 13/063 5/98.1
6,588,033 B1 * 7/2003 Welsh, Jr. ..... A47D 7/002 5/98.1
6,925,664 B1 * 8/2005 Twigg ..... A01K 1/034 5/112
7,114,205 B2 * 10/2006 Choi ..... A47C 19/14 5/115
7,617,550 B2 * 11/2009 Gehr ..... A47D 13/063 5/99.1
7,712,163 B2 * 5/2010 Flannery ..... A47C 17/74 5/115
8,162,349 B1 * 4/2012 Roselle ..... B62B 5/085 280/654
9,144,325 B1 * 9/2015 Sousa ..... A47D 7/002
(Continued)

*Primary Examiner* — George Sun

(57) ABSTRACT

A travel nursery apparatus having a scissoring frame defining four faces of a parallelepiped. A flexible receptacle is engaged to the scissoring frame where the flexible receptacle defines five faces of a parallelepiped. An infant bassinet may be engaged to the scissoring frame and depend into the flexible receptacle, with a floor of the infant bassinet being spaced from a floor of the flexible receptacle.

18 Claims, 21 Drawing Sheets

(56) References Cited

U.S. PATENT DOCUMENTS

| | | | | |
|---|---|---|---|---|
| 10,194,755 | B1 * | 2/2019 | Flannery | A47D 13/063 |
| 10,448,752 | B1 * | 10/2019 | Flannery | A47D 13/063 |
| 10,674,835 | B1 | 6/2020 | Flannery et al. | |
| 10,871,007 | B1 * | 12/2020 | Tsai | E04H 15/50 |
| 11,266,253 | B1 * | 3/2022 | Flannery | A47D 9/00 |
| 2003/0024660 | A1 * | 2/2003 | Homeyer | A47D 7/002 160/377 |
| 2007/0289060 | A1 * | 12/2007 | Berkey | A47D 9/016 5/98.1 |
| 2008/0034498 | A1 * | 2/2008 | Chen | A47D 13/063 5/99.1 |
| 2010/0229301 | A1 * | 9/2010 | Arnold, IV | A47D 11/007 5/93.2 |
| 2011/0283457 | A1 * | 11/2011 | Son | A47D 9/016 5/690 |
| 2012/0311782 | A1 | 12/2012 | Tricault | |
| 2014/0208505 | A1 * | 7/2014 | Burkholder | A47D 7/002 5/99.1 |
| 2016/0000234 | A1 * | 1/2016 | Whitman | A47D 13/061 5/99.1 |
| 2016/0309913 | A1 * | 10/2016 | Peterson | A47D 15/003 |
| 2016/0309914 | A1 * | 10/2016 | Burns | A47D 9/005 |
| 2018/0192783 | A1 * | 7/2018 | Henry | A47D 7/002 |
| 2019/0335702 | A1 * | 11/2019 | Thrift | E04H 15/48 |
| 2020/0352352 | A1 * | 11/2020 | Fusco | A47D 13/061 |
| 2020/0352353 | A1 * | 11/2020 | Fusco | A47D 13/061 |
| 2021/0137280 | A1 * | 5/2021 | Villano | A47D 15/008 |

* cited by examiner

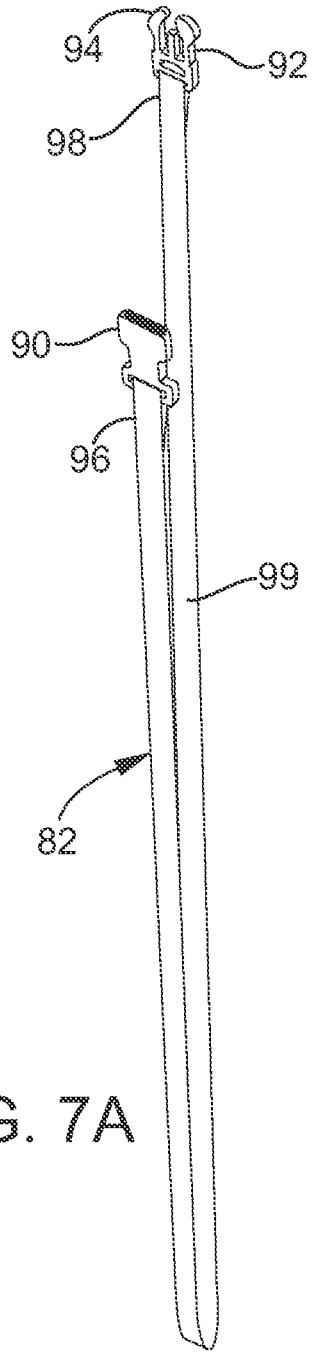
FIG. 7A
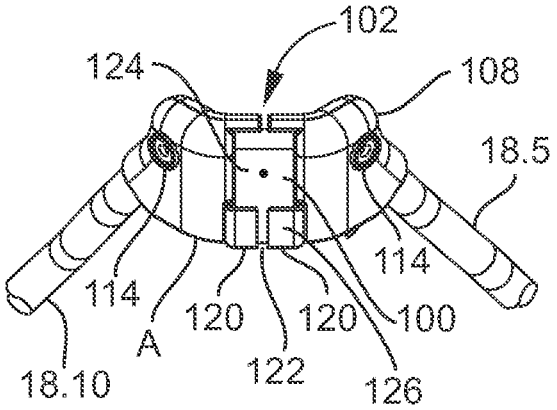
FIG. 7B
FIG. 7C
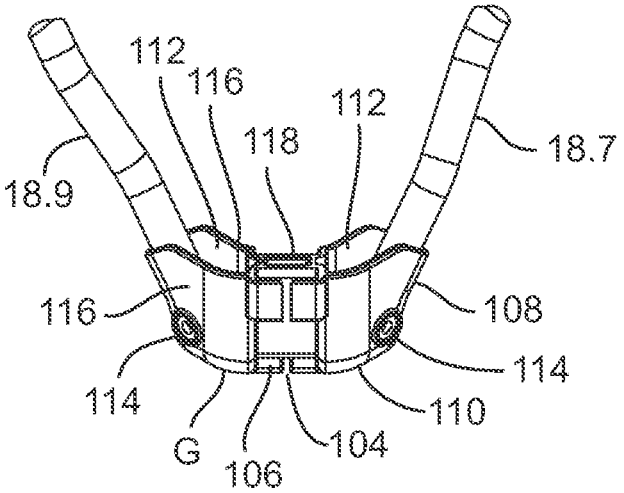

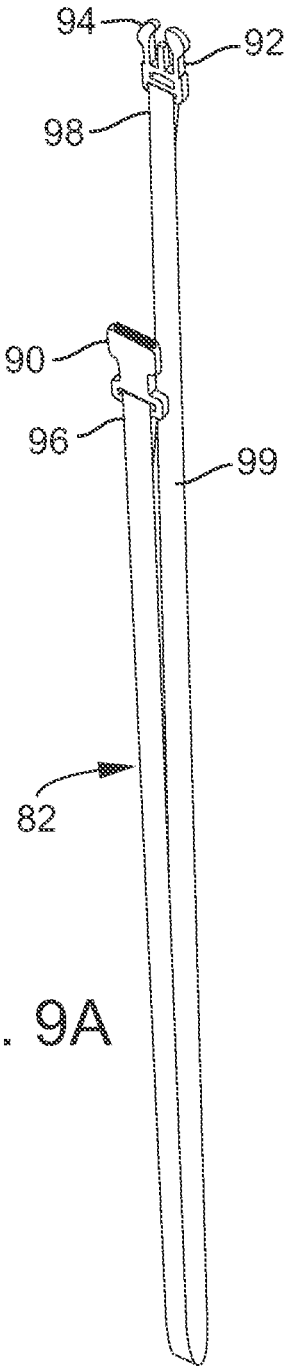
FIG. 9A
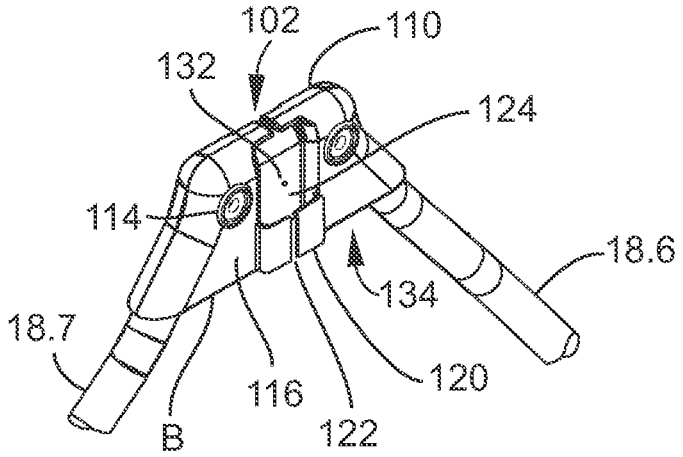
FIG. 9B
FIG. 9C
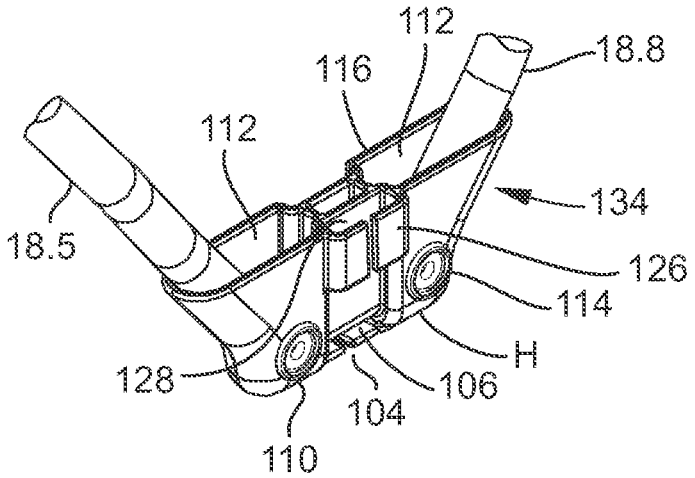

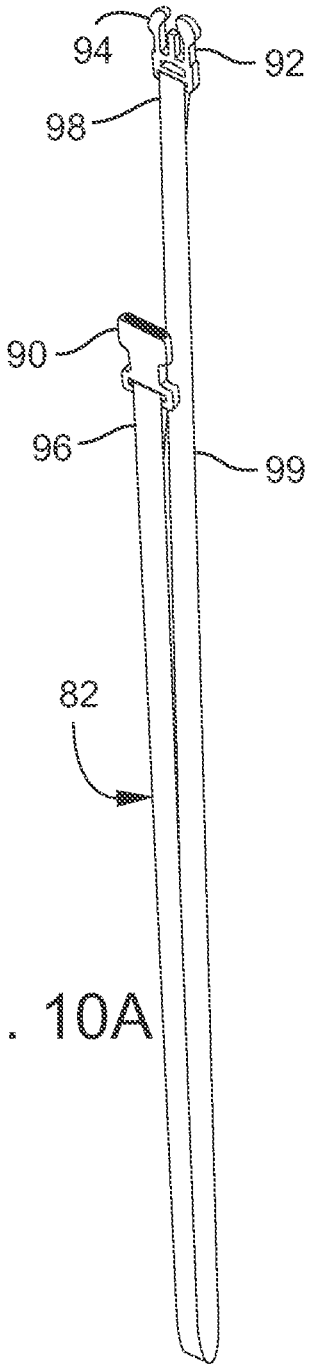
FIG. 10A
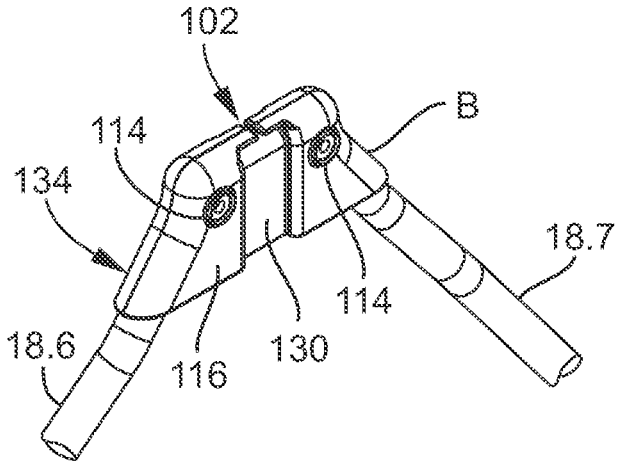
FIG. 10B
FIG. 10C
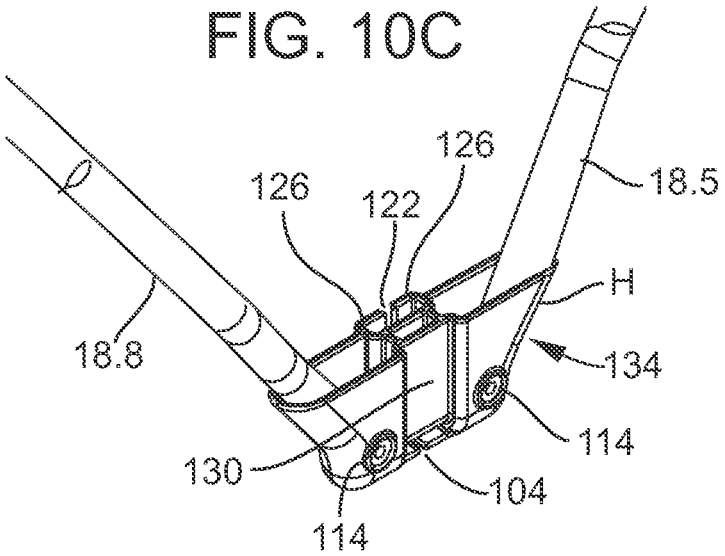

TRAVEL NURSERY APPARATUS

This application is a continuation, and claims the benefit under 35 U.S.C. § 120, of U.S. Nonprovisional patent application Ser. No. 17/229,821 filed Apr. 13, 2021 (U.S. Pat. No. 11,903,495 issued Feb. 20, 2024), which application claims the benefit under 35 U.S.C. 119(e) of U.S. Provisional Patent Application No. 63/012,749 filed Apr. 20, 2020, all of which applications are hereby incorporated by reference in their entireties into this application.

FIELD OF THE INVENTION

The present invention relates to a scissoring frame, more particularly to a scissoring frame having a flexible receptacle therein, and more specifically to a scissoring frame having a flexible receptacle therein and a bassinet depending into the flexible receptacle.

BACKGROUND OF THE INVENTION

Most beds have a rectangular sleeping surface. Most mattresses have a rectangular sleeping surface. Of course, beds and mattresses having sleeping surfaces of other shapes, such as round shapes, do exist. Beds and mattresses have rectangular sleeping surfaces because, perhaps, a person rolls from side to side when sleeping. This natural action defines a rectangular shape. If a person spins on a vertical axis while asleep, such a person may prefer a round bed.

SUMMARY OF THE INVENTION

A feature of the present invention is a travel nursery apparatus.

Another feature of the present invention is the provision in a travel nursery apparatus, of a frame where the frame includes a set of support members, upper junctions, lower junctions, and intermediate junctions, where the upper junctions and lower junctions are vertically disposed relative to each other, and where each of the upper, lower, and intermediate junctions pivotally engage at least two of the support members.

Another feature of the present invention is the provision in a travel nursery apparatus, of the frame including a first pair of support members that cross each other and a second pair of support members that cross each other, where the first and second pairs of support members are adjacent to each other, where the first and second pairs of support members engage a common upper junction, where the first and second pairs of support members engage a common lower junction, where the first pair of support members cross at a first intermediate junction, and where the second pair of support members cross at a second intermediate junction.

Another feature of the present invention is the provision in a travel nursery apparatus, of a flexible receptacle engaged to the frame and having an outer sidewall portion, an inner sidewall portion, and a floor, where the inner sidewall portion is disposed inwardly of the frame, where the outer sidewall portion is disposed outwardly of the frame, and where the outer sidewall portion and inner sidewall portion of the flexible receptacle are integral and one-piece with each other.

Another feature of the present invention is the provision in a travel nursery apparatus, of the upper junctions defining an upper rectangle and the lower junctions defining a lower rectangle.

Another feature of the present invention is the provision in a travel nursery apparatus, of the inner sidewall portion and the floor of the flexible receptacle defining five faces of a parallelepiped.

Another feature of the present invention is the provision in a travel nursery apparatus, of the support members defining a first train and a second train, where the first train includes at least six support members, at least three upper junctions, and at least three lower junctions, where the second train includes at least six support members different from that included in the first train, at least three upper junctions different from that included in the first train, and at least three lower junctions different from that included in the first train, and where the first train weaves into and out of the second train.

Another feature of the present invention is the provision in a travel nursery apparatus, of each of the support members including a straight portion, where the first pair of support members includes an upwardly extending support member that extends from a lower junction G to an upper junction B, where the second pair of support members includes an upwardly extending support member that extends from a lower junction H to an upper junction C, and where the straight portions of the upwardly extending support members are disposed in a common plane.

Another feature of the present invention is the provision in a travel nursery apparatus, of the first pair of support members including a downwardly extending support member that extends from an upper junction A to a lower junction H, where the second pair of support members includes a downwardly extending support member that extends from upper junction B to a lower junction I, and where the straight portions of the downwardly extending support members D are disposed in a common plane.

Another feature of the present invention is the provision in a travel nursery apparatus, of the frame further including a third pair of support members that cross each other and a fourth pair of support members that cross each other, where the third and fourth pair of support members are adjacent to each other, where the third and fourth pairs of support members engage a common upper junction, where the third and fourth pairs of support members engage a common lower junction, where the third pair of support members cross at a third intermediate junction, where the fourth pair of support members cross at a fourth intermediate junction, and where the third and fourth pairs of support members face the first and second pairs of support members.

Another feature of the present invention is the provision in a travel nursery apparatus, of the frame further including a fifth pair of support members that cross each other, where the fifth pair of support members share upper junctions with the first and third pairs of support members, and where the fifth pair of support members share lower junctions with the first and third pairs of support members.

Another feature of the present invention is the provision in a travel nursery apparatus, of the frame further including a sixth pair of support members that cross each other, where the sixth pair of support members share upper junctions with the second and fourth pairs of support members, and where the sixth pair of support members share lower junctions with the second and fourth pairs of support members.

Another feature of the present invention is the provision in a travel nursery apparatus, of at least one of the upper junctions being a corner upper junction, where the corner upper junction includes first and second support member receptacles with respective first and second axis, where the first and second axis are disposed in first and second planes that are disposed at a right angle to each other.

Another feature of the present invention is the provision in a travel nursery apparatus, of where at least one of the lower junctions is a corner lower junction, where the corner lower junction includes first and second support member receptacles with respective first and second axis, where the first and second axis are disposed in first and second planes that are disposed at a right angle to each other.

Another feature of the present invention is the provision in a travel nursery apparatus, of the intermediate junction including a pin engaging crossing support members.

Another feature of the present invention is the provision in a travel nursery apparatus, of the intermediate junction including a piece having first and second through openings, where a first support member extends through the first through opening and is pivotally engaged to the piece, where a second support member extends through the second through opening and is pivotally engaged to the piece, where each of the first and second through opening is oblong in shape, where the first and second through opening are offset from each other, where each of the first and second through openings includes opposing ends, where each of the opposing ends include upper and lower portions, where the first support member engages a lower portion of one opposing end and an upper portion of the other opposing end of the first through opening when the frame has been scissored completely out to provide stops for such scissoring, and where the second support member engages a lower portion of one opposing end and an upper portion of the other opposing end of the second through opening when the frame has been scissored completely out to provide stops for such scissoring.

Another feature of the present invention is the provision in a travel nursery apparatus, of a bassinet apparatus engaged to upper junctions of the frame of the travel nursery apparatus, where the bassinet apparatus depends into the flexible receptacle, where the bassinet apparatus includes a floor that is spaced from the floor of the flexible receptacle.

Another feature of the present invention is the provision in a travel nursery apparatus, of a bassinet apparatus engaged to upper junctions of the frame of the travel nursery apparatus, where the bassinet apparatus depends into the flexible receptacle, where the bassinet apparatus includes a floor that is spaced from the floor of the flexible receptacle, and where the upper junctions include four corner upper junctions.

Another feature of the present invention is the provision in a travel nursery apparatus, of a bassinet apparatus engaged to upper junctions of the frame of the travel nursery apparatus, where the bassinet apparatus depends into the flexible receptacle, where the bassinet apparatus includes a floor that is spaced from the floor of the flexible receptacle, where the upper junctions include four corner upper junctions and two side upper junctions, and where each of the side upper junctions is disposed between two of the corner upper junctions.

An advantage of the present invention is a scissoring frame that folds out to a parallelepiped shape to provide a rectangular shaped sleeping surface for a child.

Another advantage of the present invention is a scissoring frame that provides a platform for a rectangular shaped bassinet.

Another advantage of the present invention is that the scissoring frame automatically stops folding out at a predefined position.

Another advantage of the present invention is that the stop that stops the automatic folding out includes no moving parts.

Another advantage is that the scissoring frame folds up into a compact state.

Another advantage is that the bassinet is reducible to a compact state.

Another advantage is that the scissoring frame is easily and quickly folded out and easily and quickly folded in.

Another advantage is that the bassinet is easily and quickly set up, easily and quickly engaged to the scissoring frame, easily and quickly disengaged from the scissoring frame, and easily and quickly reduced to a compact state.

Another advantage is that the travel nursery apparatus, including the scissoring frame, flexible receptacle, and bassinet are simple and inexpensive to manufacture.

BRIEF DESCRIPTION OF THE DRAWINGS

FIG. 7A is a perspective view of a strap of the travel nursery apparatus of FIG. 1 for engaging upper and lower junctions of the frame of FIG. 2.

FIG. 7B is a perspective front view of an upper corner junction of the frame of FIG. 2 that is engaged by the strap of FIG. 7A.

FIG. 7C is a perspective front view of a lower corner junction of the frame of FIG. 2 that is engaged by the strap of FIG. 7A.

FIG. 9A is a perspective view of a strap of the travel nursery apparatus of FIG. 1 for engaging upper and lower junctions of the frame of FIG. 2.

FIG. 9B is a perspective front view of an upper side junction of the frame of FIG. 2 that is engaged by the strap of FIG. 9A.

FIG. 9C is a perspective front view of a lower side junction of the frame of FIG. 2 that is engaged by the strap of FIG. 9A.

FIG. 10A is a perspective view of a strap of the travel nursery apparatus of FIG. 1 for engaging upper and lower junctions of the frame of FIG. 2.

FIG. 10B is a perspective rear view of an upper side junction of the frame of FIG. 2 that is engaged by the strap of FIG. 10A.

FIG. 10C is a perspective rear view of a lower side junction of the frame of FIG. 2 that is engaged by the strap of FIG. 10A.

DESCRIPTION

Figure 1:
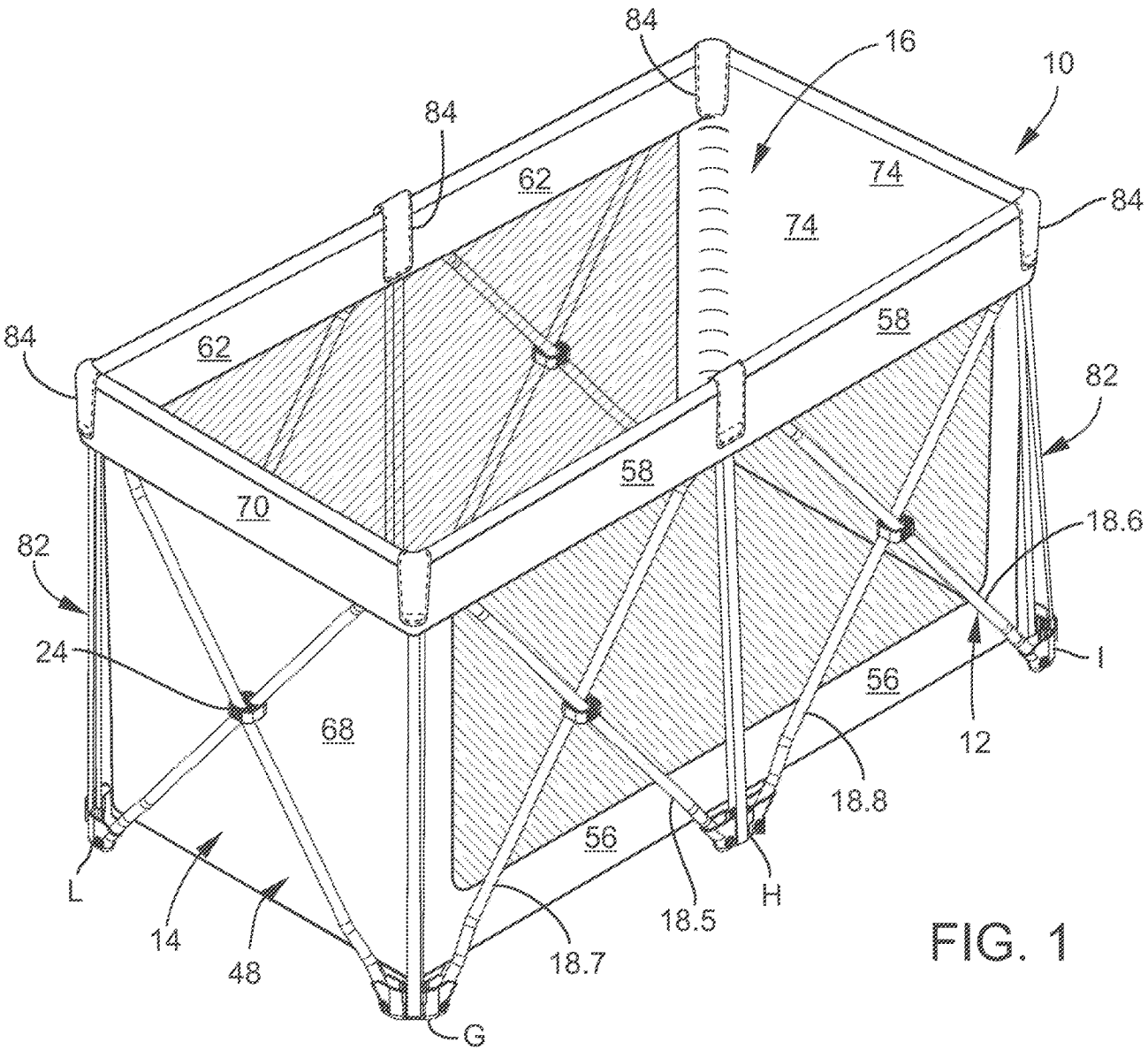
FIG. 1 is a perspective view of a first embodiment of the travel nursery apparatus of the present invention.

As shown in FIG. 1, a travel nursery apparatus is indicated by the reference number 10. Travel nursery apparatus 10 includes a frame 12 and a flexible receptacle 14 engaged to the frame 12. In the embodiment shown in FIG. 1, the travel nursery apparatus 10 includes an open top 16.

Figure 2:
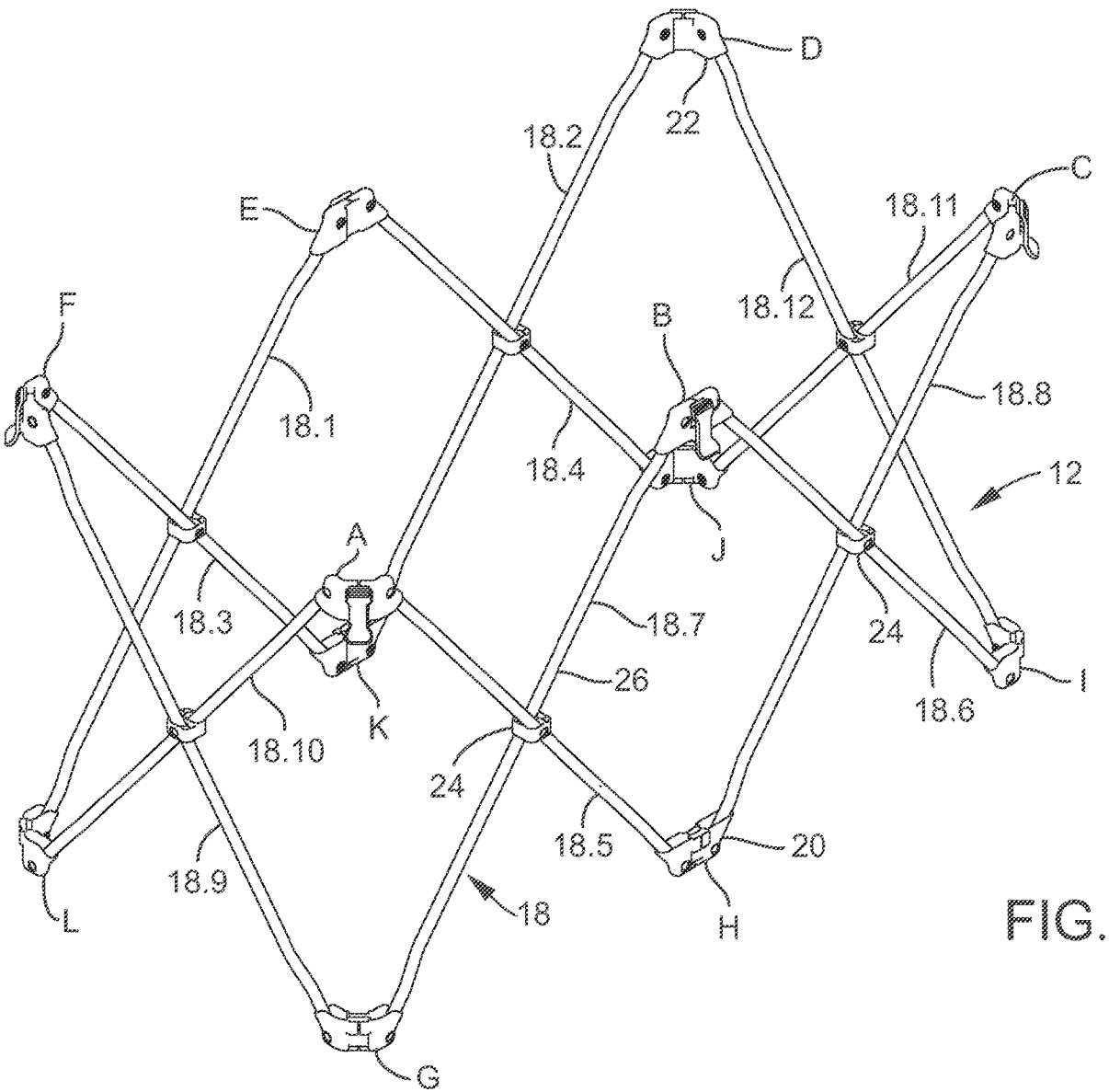
FIG. 2 is a perspective view of a frame for the travel nursery apparatus of FIG. 1.

As shown in FIG. 2, the frame 12 includes a set of support members 18, lower junctions 20, upper junctions 22, and intermediate junctions 24. The individual upper junctions are identified by reference letters A, B, C, D, E, and F. The individual lower junctions are identified by reference letters G, H, I, J, K, and L. Upper junctions A, C, D, and F are corner upper junctions. Lower junctions G, I, J, and L are corner lower junctions. Upper junctions B and E are side or center upper junctions. Lower junctions H and K are side or center lower junctions.

Frame 12 is a scissoring frame 12. Frame 12 includes a set of six pairs of crossing support members 18. One pair of crossing support members 18 is identified by those support members 18 that engage upper junctions A and B and lower junctions G and H.

Each of the support members 18 is pivotally engaged at an upper junction 22, at a lower junction 20, and at an intermediate junction 24. Each of the upper junctions 22 pivotally engages two support members 18. Each of the intermediate junctions 24 pivotally engages two support members 18. Each of the lower junctions 20 pivotally engages two support members 18.

Support member 18 is tubular and formed of a metal such as stainless steel or aluminum. Support member 18 includes an elongate straight central portion 26 that is pivotally engaged by and passes through the intermediate junctions 24. Support member 18 includes a pair of straight end portions 28 that are received by one of the lower or upper junctions 20, 22. Support member 18 includes a pair of straight oblique portions 30. Each of the oblique portions 30 is disposed between a straight end portion 28 and the elongate straight central portion 26. Elongate straight central portion 26 runs parallel to its straight end portions 28.

Figure 3:
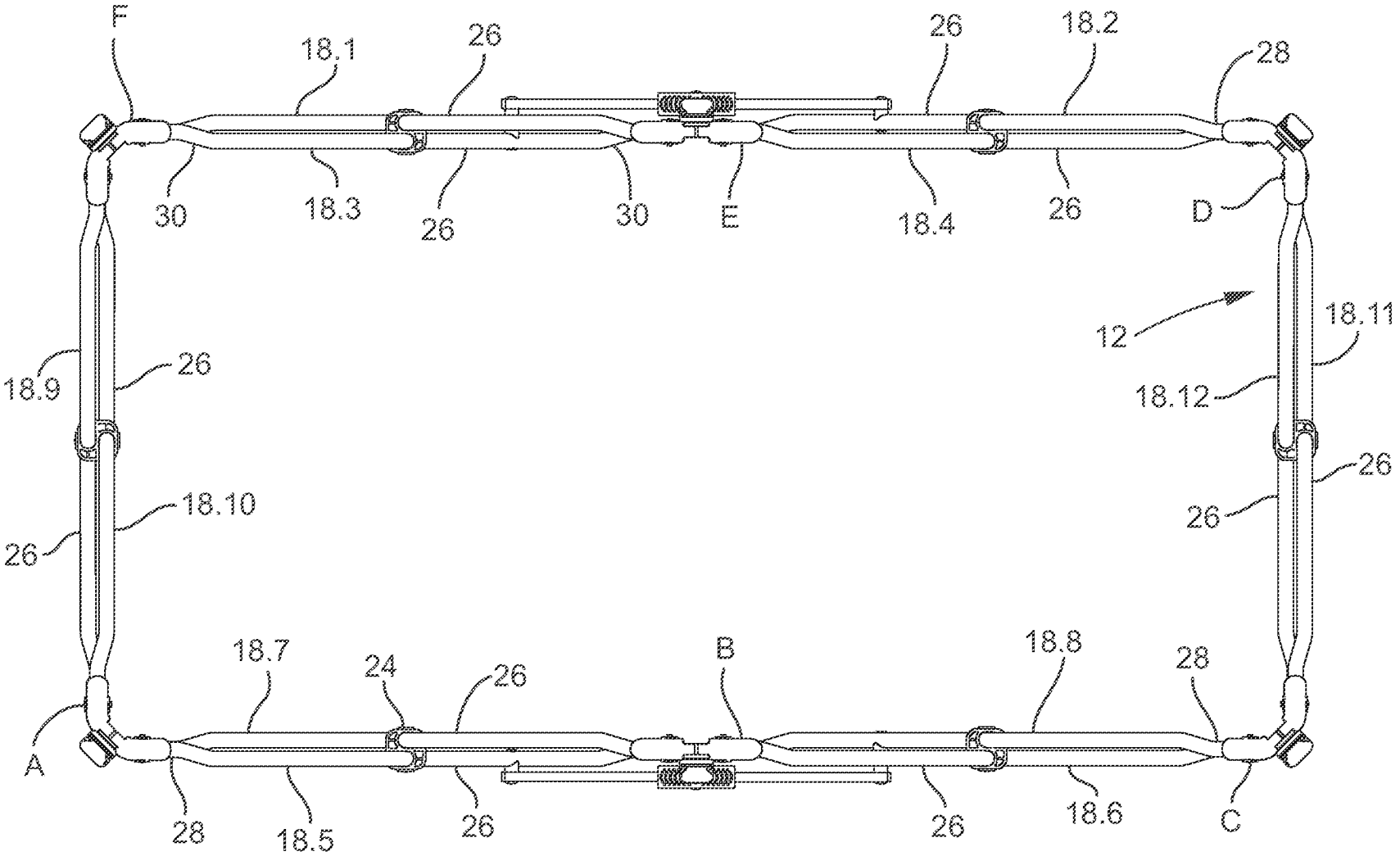
FIG. 3 is a top view of the frame of FIG. 2.

As shown in FIG. 3, a support member 18.1 runs upwardly and obliquely to upper junction E and a support member 18.2 runs upwardly and obliquely to upper junction D. Support members 18.1 and 18.2 have outwardly disposed elongate straight central portions 26. These outwardly disposed elongate straight central portions 26 of support members 18.1 and 18.2 are disposed in a common plane when the scissoring frame 12 has been folded out to an operating state or when the scissoring frame 12 has been folded in to a compact state or during the process of folding in or out the scissoring frame 12.

As shown in FIG. 3, a support member 18.3 runs upwardly and obliquely to upper junction F and a support member 18.4 runs upwardly and obliquely to upper junction E. Support members 18.3 and 18.4 have inwardly disposed elongate straight central portions 26. These inwardly disposed elongate straight central portions 26 of support members 18.3 and 18.4 are disposed in a common plane when the scissoring frame 12 has been folded out to an operating state or when the scissoring frame 12 has been folded in to a compact state or during the process of folding in or out the scissoring frame 12.

As shown in FIG. 3, a support member 18.5 runs upwardly and obliquely to upper junction A and a support member 18.6 runs upwardly and obliquely to upper junction B. Support members 18.5 and 18.6 have outwardly disposed elongate straight central portions 26. These outwardly disposed elongate straight central portions 26 of support members 18.5 and 18.6 are disposed in a common plane when the scissoring frame 12 has been folded out to an operating state or when the scissoring frame 12 has been folded in to a compact state or during the process of folding in or out the scissoring frame 12.

As shown in FIG. 3, a support member 18.7 runs upwardly and obliquely to upper junction B and a support member 18.8 runs upwardly and obliquely to upper junction C. Support members 18.7 and 18.8 have inwardly disposed elongate straight central portions 26. These inwardly disposed elongate straight central portions 26 of support members 18.7 and 18.8 are disposed in a common plane when the scissoring frame 12 has been folded out to an operating state or when the scissoring frame 12 has been folded in to a compact state or during the process of folding in or out the scissoring frame 12.

In other words, on the longer sides of the rectangular scissoring frame 12, outwardly disposed elongate straight central portions 26 lie in a common plane during use, set-up, and take down. Also, on the longer sides of the rectangular scissoring frame 12, inwardly disposed elongate straight central portions 26 lie in a common plane during use, set-up, and take down.

As shown in FIG. 2, support member 18.1 runs from lower corner junction L to upper central junction E, support member 18.2 runs from lower central junction K to upper corner junction D, support member 18.3 runs from lower central junction K to upper corner junction F, support member 18.4 runs from lower corner junction J to upper central junction E, support member 18.5 runs from lower central junction H to upper corner junction A, support member 18.6 runs from lower corner junction I to upper central junction B, support member 18.7 runs from lower corner junction G to upper central junction B, and support member 18.8 runs from lower central junction H to upper corner junction C.

Scissoring rectangular frame 12 includes two ends or fifth and sixth pairs of support members 18. One end includes support member 18.9 having an outwardly disposed elongate straight central portion 26 and support member 18.10 having an inwardly disposed elongate straight central portion 26. The opposite end includes support member 18.11 having an outwardly disposed elongate straight central portion 26 and support member 18.12 having an inwardly disposed elongate straight central portion 26.

The support members 18 define a first train running from junction A to support member 18.5 to junction H to support member 18.8 to junction C to support member 18.11 to junction J to support member 18.4 to junction E to support member 18.1 to junction L to support member 18.10 and back to junction A.

The support members 18 define a second train running from junction G to support member 18.7 to junction B to support member 18.6 to junction I to support member 18.12 to junction D to support member 18.2 to junction K to support member 18.3 to junction F to support member 18.9 and back to junction G.

The first train includes at least six support members 18, at least three the upper junctions (A, C and E), and at least three lower junctions (H, J, and L). The second train includes at least six support members different from that included in the first train, at least three upper junctions (B, D, and F) different from that included in the first train, and at least three lower junctions (G, I, and K) different from that included in the first train. It is noted that the first train weaves into and out of the second train, or that the second train weaves into and out of the first train. The first and second trains are pivotally engaged to each other and, at the same time, are different and distinct trains such that the first and second trains do not share junctions or support members 18.

Frame 12 can also be described as including a first pair of support members 18.5, 18.7 that cross each other, a second pair of support members 18.6, 18.8 that cross each other, where such first and second pairs of support members 18.5, 18.7 and 18.6, 18.8 are adjacent to each other, where the first and second pairs of support members 18.5, 18.7 and 18.6, 18.8 engage a common upper junction B and a common lower junction H, where the first pair of support members 18.5, 18.7 cross at a first intermediate junction 24, and where the second pair of support member 18.6, 18.8 cross at a second intermediate junction 24.

Frame 12 can also be described as including a third pair of support members 18.3, 18.1 that cross each other, a fourth pair of support members 18.4, 18.2 that cross each other, where such third and fourth pairs of support members 18.3, 18.1 and 18.4, 18.2 are adjacent to each other, where the third and fourth pairs of support members 18.3, 18.1 and 18.4, 18.2 engage a common upper junction E and a common lower junction K, where the third pair of support members 18.3, 18.1 cross at a third intermediate junction 24, and where the fourth pair of support member 18.4, 18.2 cross at a fourth intermediate junction 24. The third and fourth pairs of support members 18.3, 18.1 and 18.4, 18.2 face or oppose the first and second pairs of support members 18.5, 18.7 and 18.6, 18.8.

Frame 12 includes the following pairs of upper and lower junctions that are disposed vertically relative to each other: 1) junctions A and G, 2) junctions B and H, 3) junctions C and I, 4) junctions D and J, 5) junctions E and K, and 6) junctions F and L.

Upper junctions A, B, C, D, E, and F define an upper rectangle. Lower junctions G, H, I, J, K, and L define a lower rectangle. Frame 12 as a whole defines six faces of a parallelepiped. A first side face is defined by junctions A, B, C, G, H, and I. A second side face is defined by junctions D, E, F, J, K, and L. A first end face is defined by junctions A, F, G, and L. A second end face is defined by junctions C, D, I, and J. A bottom face is defined by junctions G, H, I, J, K, and L. A top face is defined by junctions A, B, C, D, E, and F.

The fifth pair of support members 18.9, 18.10 that cross each other share upper junctions A and F with the first pair of support members 18.5, 18.7 and the third pair of support members 18.1, 18.3. The fifth pair of support members 18.9, 18.10 that cross each other share lower junctions G and L with the first pair of support members 18.5, 18.7 and the third pair of support members 19.1, 18.3.

The sixth pair of support members 18.11, 18.12 that cross each other share upper junctions C, D with the second pair of support members 18.6, 18.8 and the fourth pair of support members 18.2, 18.4. The sixth pair of support members 18.11, 18.12 that cross each other share lower junctions I, J with the second pair of support members 18.6, 18.8 and the fourth pair of support members 18.2, 18.4.

Figure 4A:
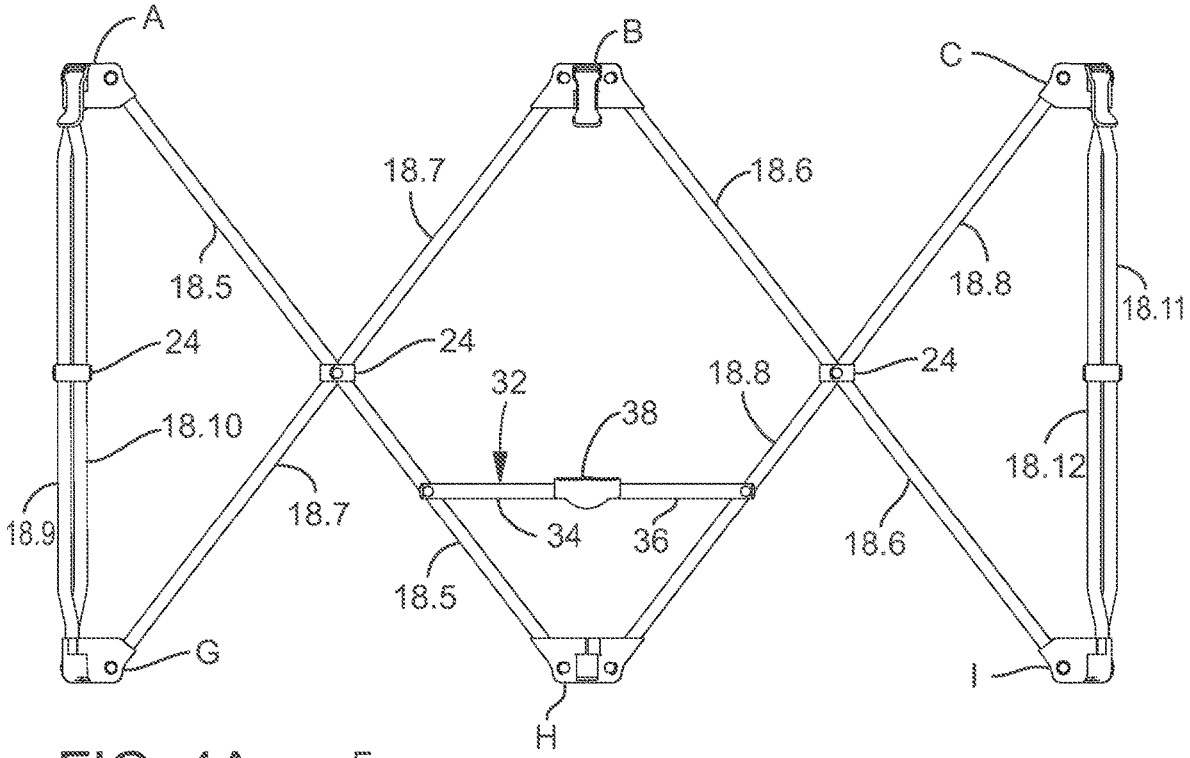
FIG. 4A is a side elevation view of the frame of FIG. 2.

FIG. 4A shows the first and second pairs of support members 18.5, 18.7 and 18.6 and 18.8 that cross each other, the fifth pair of support members 18.9, 18.10 that cross each other, and the sixth pair of support members 18.11, 18.12 that cross each other. FIG. 4A further shows an over center lock apparatus 32. Over center lock apparatus 32 includes a first straight member 34, a second straight member 36, and a push/pull lock 38. Member 34 is pivotally engaged to each of support member 18.5 and to lock 38. Member 36 is pivotally engaged to each of support member 18.8 and lock 38. Members 34, 36 have inner ends that abut each other. When lock 38 is pushed down, frame 12 scissors out, and the proximal ends of members 34, 36 come into contact under pressure. Then, when lock 38 is pushed further downwardly, the proximal ends of members 34, 36 reach an over center position where the axis of members 34, 36 form a slight upright V. Such locks the frame 12 from scissoring in or moving toward the compact state. When the user decides to take down the frame 12, the user pushes or pulls upwardly on the lock 38, an action that takes the members 34, 36 through the over center point and back to a state where the axis of the members 34, 36 form an inverted V. As to over center lock apparatus 32, the Flannery et al. U.S. Pat. No. 10,448,752 B1 issued Oct. 22, 2019 and entitled Playyard is hereby incorporated by reference in its entirety.

Figure 4B:
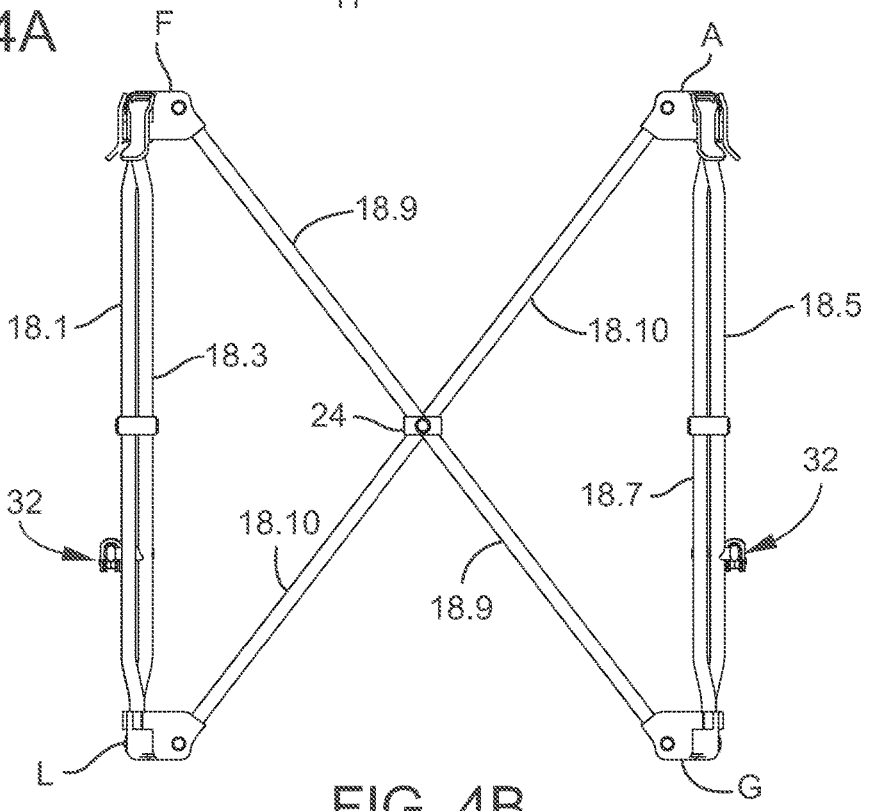
FIG. 4B is an end elevation view of the frame of FIG. 2.

FIG. 4B shows the fifth pair of support members 18.9, 18.10 that cross each other. FIG. 4B further shows that each of the longer sides of the parallelepiped includes the over center lock apparatus 32 such that a first over center lock apparatus 32 is engaged between support members 18.5 and 18.8 and that a second over center lock apparatus 32 is engaged between support members 18.2 and 18.3.

Figure 5C:
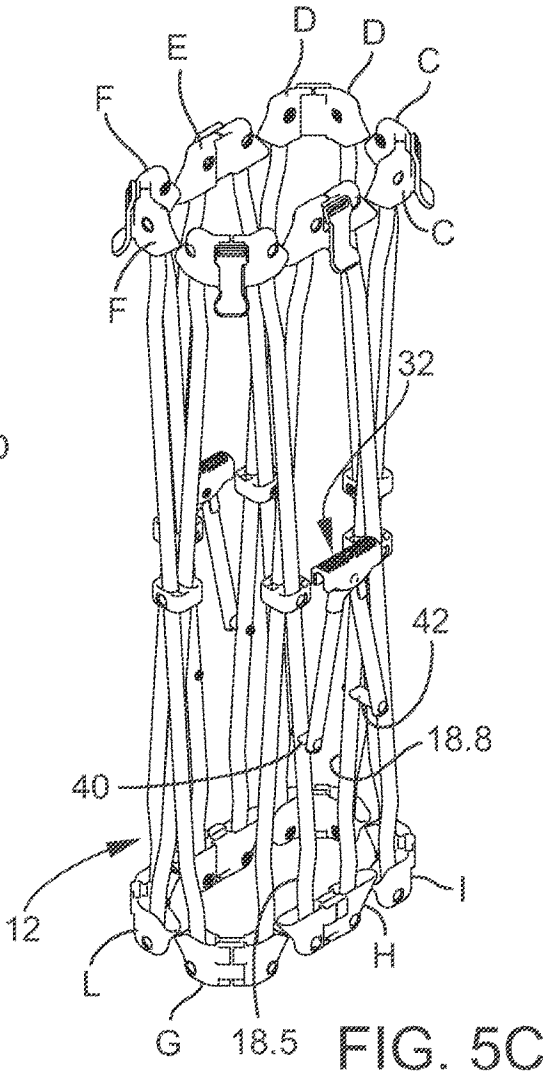
FIG. 5C is a perspective view of the collapsed frame of FIG. 5A.
Figure 5B:
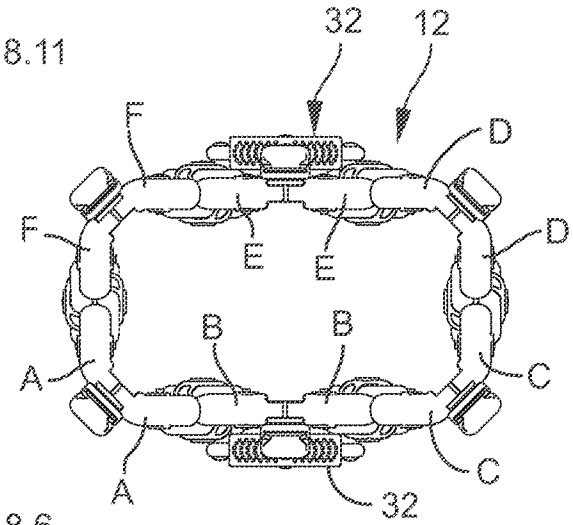
FIG. 5B is a top view of the collapsed frame of FIG. 5A.
Figure 5A:
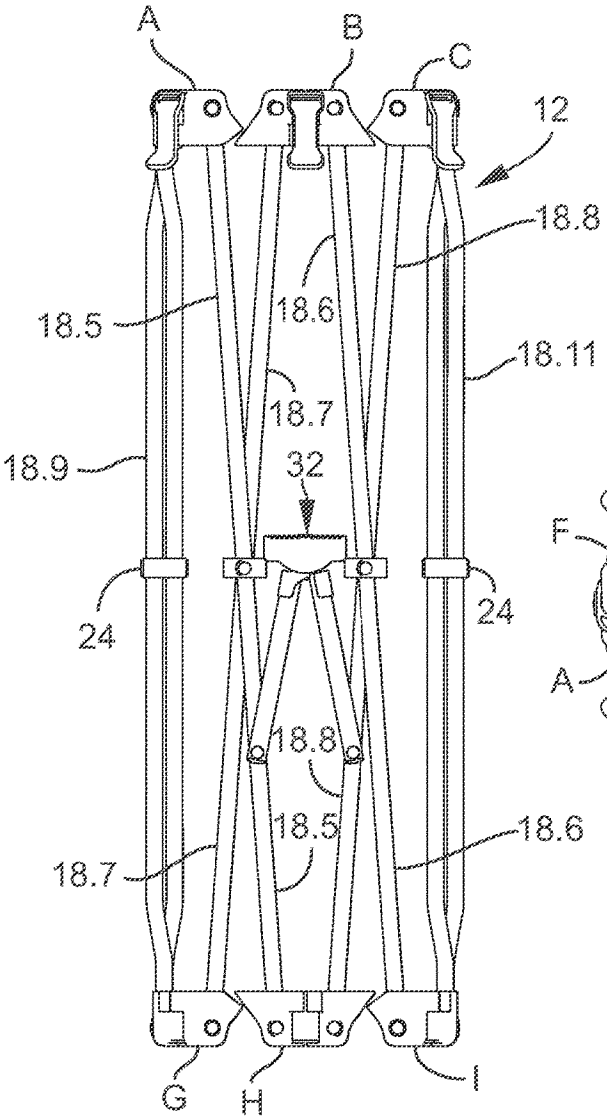
FIG. 5A is a side elevation view of the frame of FIG. 4A in a collapsed state.

FIG. 5A shows the inverted V state of the over center lock apparatus 32. FIG. 5A further shows that the upper junctions A and C confront and are adjacent to upper junction B when the frame 12 is in the compact state. FIG. 5A further shows that the lower junctions G and I confront and are adjacent to lower junction H when the frame 12 is in the compact state.

FIG. 5B shows that each of the over center lock apparatus 32 is disposed on one of the long sides of the rectangular frame 10. FIG. 5B further shows that each of the upper junctions confronts and is adjacent to two other upper junctions when the frame 12 is in the compact state.

FIG. 5B further shows that the upper junctions A, B, C, D, E and F define a rectangle when the frame 12 is in the folded in and compact state.

FIG. 5C shows that each of the upper junctions confront and are adjacent to two other upper junctions when the frame 12 is in the compact state. FIG. 5C further shows that each of the lower junctions confront and are adjacent to two other lower junctions when the frame 12 is in the compact state.

FIG. 5C further shows that the distal ends of members 34, 36 are not directly affixed to their respective support members 18.5, 18.8. Rather, a relatively short spacer 40 is disposed between the distal end of member 34 and support member 18.5 and a relatively long spacer 42 is disposed between the distal end of member 36 and support member 18.8. Support member 18.8 includes an inwardly disposed elongate straight central portion 26 and thus here the spacer 42 is relatively long. Support member 18.5 includes an outwardly disposed elongate straight central portion 26 and thus here the spacer 40 is relatively short.

FIG. 5C further shows that the frame 12 defines a parallelepiped when the frame 12 is in the folded in and compact state.

FIG. 5C further shows that the upper junctions A, B, C, D, E and F define a rectangle when the frame 12 is in the folded in and compact state and that the lower junctions G, H, I, J, K, and L define a rectangle when the frame 12 is in the folded in and compact state.

Figure 6:
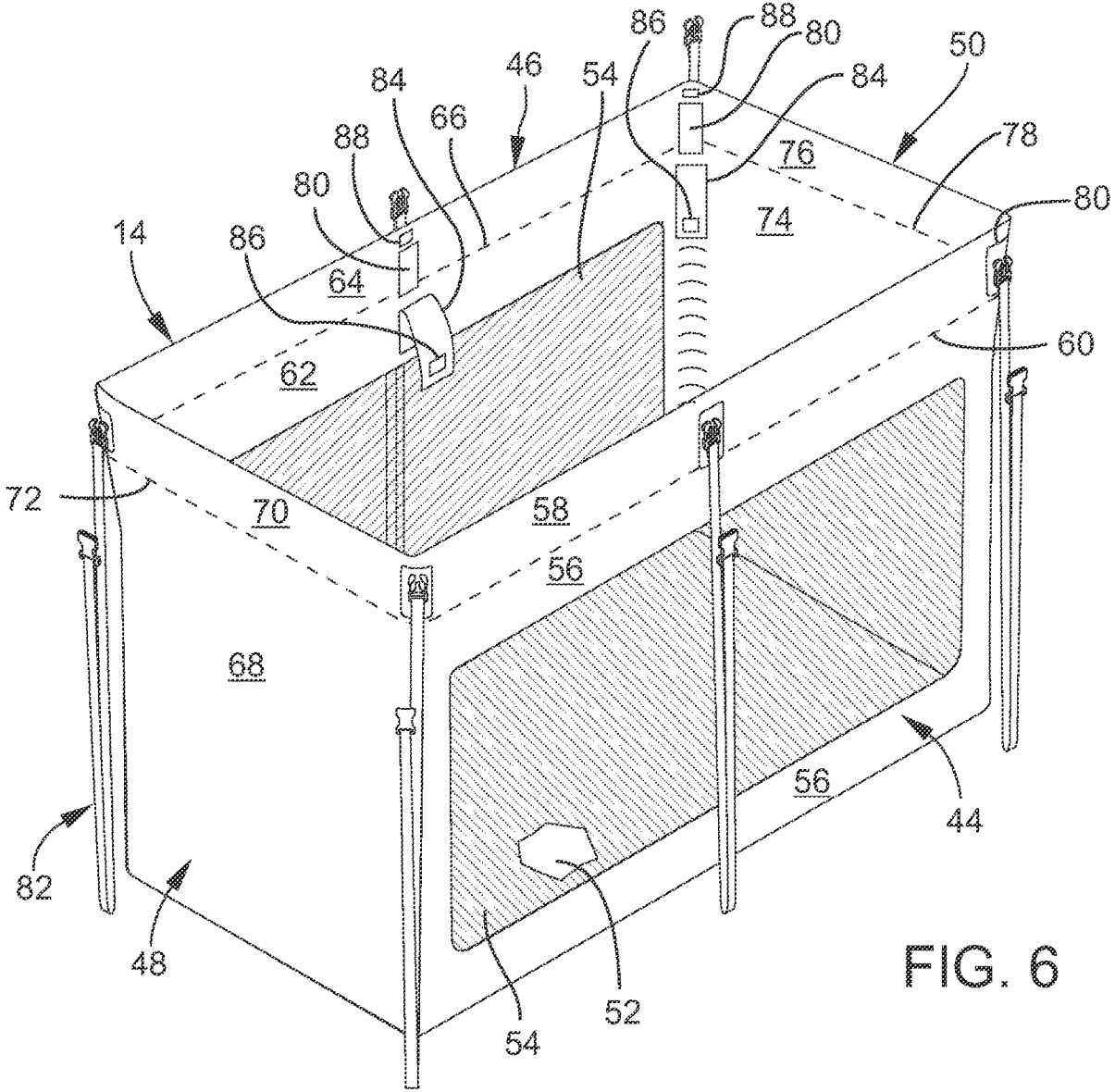
FIG. 6 is a perspective view of soft components of the travel nursery apparatus of FIG. 1.

FIG. 6 shows the flexible receptacle 14. Flexible receptacle 14 includes first and second sidewalls 44, 46, first and second end walls 48, 50, and a floor 52. With open top 16, flexible receptacle 14 defines a parallelepiped.

Each of first and second sidewalls 44, 46 includes a mesh or see through portion 54. First sidewall 44 includes an inner wall portion 56 and an outer wall portion 58 separated by a fold line 60. Second sidewall 46 includes an inner wall portion 62 and an outer wall portion 64 separated by a fold line 66.

First end wall 48 includes an inner wall portion 68 and an outer wall portion 70 separated by a fold line 72. Second end wall 50 includes an inner wall portion 74 and an outer wall portion 76 separated by a fold line 78.

FIG. 1 shows the outer wall portions 58, 64, 70, and 76 folded over the upper junctions A, B, C, D, E, and F. When the frame 12 is in the folded out or operating state, this folded over state of the outer wall portions 58, 64, 70, and 76 engages the flexible receptacle 14 to the frame 12 without need for any further engagement. If desired, a tighter engagement may be provided where the outer wall portions 58, 64, 70, and 76 are folded over such upper junctions A, B, C, D, E, and F prior to the frame 12 being fully folded out. The process of fully folding out frame 12, after the outer wall portions 58, 64, 70, 76 have been folded over the upper junctions A, B, C, D, E, and F, tightens and slightly expands the outer wall portions 58, 64, 70, and 76. Preferably flexible receptacle 14 is made of a nonstretch flexible material or nonstretch fabric such that such tightening takes place as the frame 12 is fully folded out.

Flexible receptacle 14 includes a set of six openings 80 for permitting straps 82 for passing therethrough. Straps 82 engage paired vertically disposed upper and lower junctions A and G, B and H, C and I, D and J, E and K, and F and L. Each of the openings 80 intersects one or more fold lines 60, 66, 70, 76. Adjacent to each of the openings 80 is a flap 84 for covering its adjacent opening 80. Flaps 84 are engaged to one or more of the inner walls 56, 62, 68, 74 and are of sufficient width and length to completely cover opening 80. On one of its ends, flap 84 includes a first fabric quick connect piece 86, such as a Velcro® piece, that engages a second fabric quick connect piece 88, such as a Velcro® piece to tie down or engage the flap 84 over opening 80. There are six second fabric quick connect pieces 88, each engaged directly below opening 80 on the outer faces of outer walls 58, 64, 70, 76.

FIG. 7A is a detail perspective view of strap 82. Strap 82 includes a female buckle end 90 and male buckle end 92. Buckle ends 90, 92 are quick connectors. Curved barbed prongs 94 can be quickly inserted into female buckle end 90 with or without pinching the prongs 94 together. After connection with female buckle end 90, barbed prongs 94 can be resiliently pinched together such that the prongs 94 can be slipped out of the female buckle end 90.

Female buckle end 90 is pivotable relative to strap end 96 to which the female buckle end 90 is engaged. Strap end 96 includes a flexible strap loop that engages a slot in the female buckle end 90.

Male buckle end 92 is pivotable relative to strap end 98 to which the male buckle end 92 is engaged. Strap end 98 includes a flexible strap loop that engages a slot in the male buckle end 92.

Between the flexible strap ends 96 and 98, strap 82 includes a strap body 99. Strap body 99 may be made of a fabric or polymer such as nylon. Strap body is flexible and flat.

Strap or strap apparatus 82 engages upper corner junction A and lower corner junction G that are shown in FIGS. 7B and 7C. Joints A and G are identical. To use upper corner junction A as lower corner junction G, junction A is rotated 180 degrees about a horizontal central axis 100.

Each of junctions A and G includes a T-shaped slot 102. Slot 102 includes a vertical slot portion 104 that communicates with a horizontal slot portion 106. Strap body 99 can be inserted into vertical slot portion 104 and then slid into horizontal slot portion 106. The width of slot portions 104, 106 are less than the thickness of either of the female or male buckle ends 90, 92 such that the ends 90, 92 cannot slide through any portion of T-shaped slot 102. After portions of the strap body 99 have been engaged in horizontal slot portion 106, female and male buckle ends 90, 92 are engaged. Strap 82 preferably has a fixed length such that the desired amount of tension between junctions A and G is attained. However, if desired, a strap 82 that is adjustable in length may be used. Junction A is identical to corner junctions C, D, and F. Junction G is identical to corner junctions I, J, and L.

Figure 11:
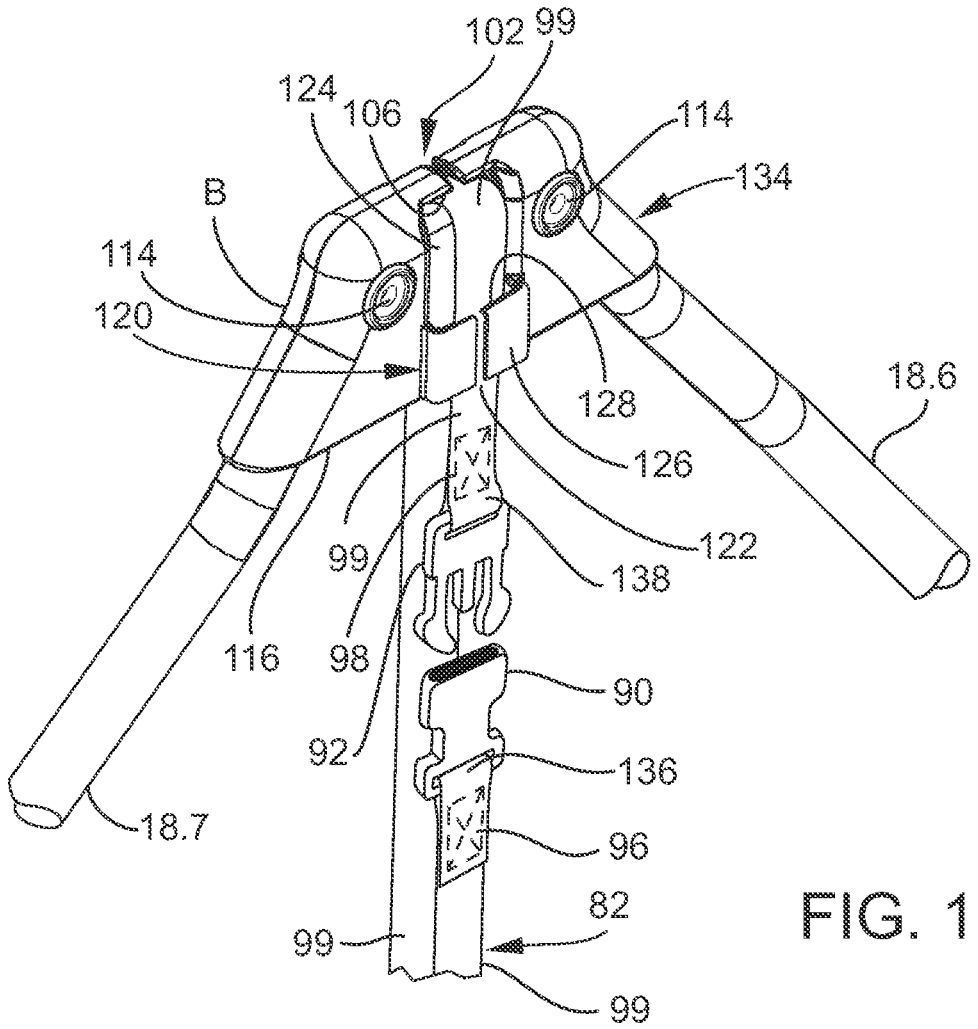
FIG. 11 is a detail perspective front view of the upper side junction of FIG. 9B that is engaged by the strap of FIG. 9A.

Each of corner junctions A, C, D, F, G, I, J, and L have the structure shown in FIGS. 7B, 7C, 8B, and 8C. Each of these corner junctions thus can be given the reference numeral 108. Corner junction 108 is formed of a hard polymer or plastic. Corner junction 108 includes a floor (or ceiling) 110. Corner junction 108 includes a pair of pockets 112 for receiving support members 18. Pockets 112 are disposed at right angles relative to each other. For example, pockets 112 of junction G receive support members 18.9 and 18.7. Pivots pins 114 are anchored by sidewalls 116. Each of the pivot pins 114 pivotally engages an end of one support member 18. The end portion of such support member 18 swings on pin 114 back and forth in its respective pocket 112 when the frame 12 is folded in to the compact state and folded out to the expanded operating state. Pockets 112 are separated from each other by an intermediate junction section 118 that extends between the sidewalls 116 and that extends between the pockets 112. T-slot 102 is formed in this intermediate junction section 118. Further formed in this intermediate junction section 118 is a pair of opposed L-shaped pieces 120 that form a slot 122 therebetween. Strap body 99 is inserted sideways into this slot 122 and then lays flat against surface 124 of the intermediate junction section 118. L-shaped pieces 120 have outer plate sections 126 that are spaced from surface 124 so as to form a slot 128 for engaging strap body 99. Slot 128 is shown in FIG. 11.

Figure 8A:
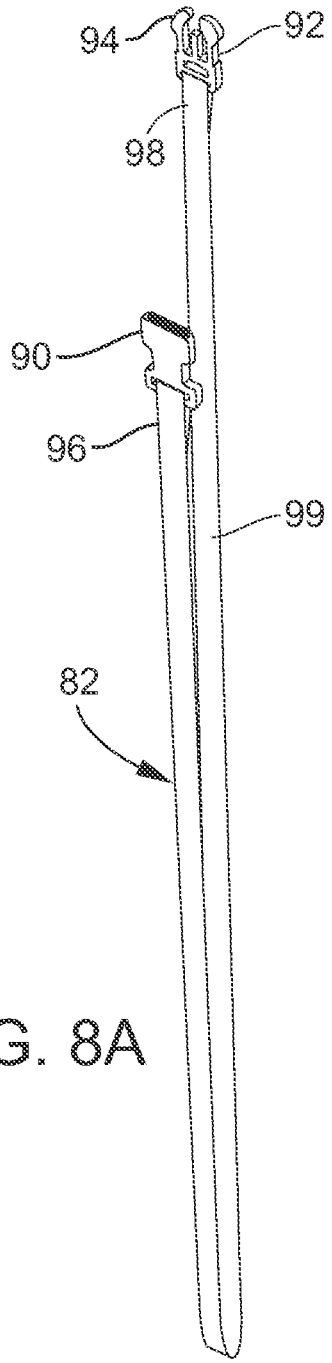
FIG. 8A is a perspective view of a strap of the travel nursery apparatus of FIG. 1 for engaging upper and lower junctions of the frame of FIG. 2.
Figure 8B:
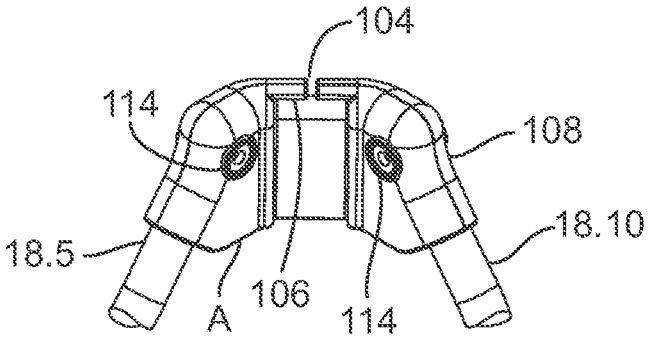
FIG. 8B is a perspective rear view of an upper corner junction of the frame of FIG. 2 that is engaged by the strap of FIG. 8A.
Figure 8C:
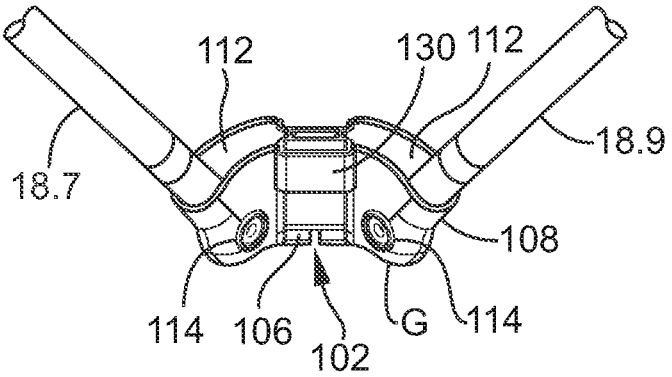
FIG. 8C is a perspective rear view of a lower corner junction of the frame of FIG. 2 that is engaged by the strap of FIG. 8A.

FIG. 8A shows the strap apparatus 82 of FIG. 7A. FIG. 8B shows a rear view of corner junction 108. FIG. 8C shows a rear view of corner junction 108. A rear portion 130 of the intermediate junction section 118 does not include the L-shaped pieces 120. Rear portion 130 is flat and confronts the face of the strap body 99.

FIG. 9A shows the strap apparatus 82 of FIG. 7A. FIG. 9B shows a front view of upper center junction B. FIG. 9C shows a front view of lower center junction H. Upper center junction B is identical to lower center junction H. To use upper center junction B as lower center junction H, upper center junction B is rotated for 180 degrees around horizontal axis 132. Upper center junction B is identical to upper center junction E and lower center junction K. All of such center junctions are designated by the reference number 134.

Center junction 134 is identical to corner junction 108 except that, with center junction 134, pockets 112 define a common plane. With corner junction 108, pockets 112 are disposed at a right angle relative to each other.

Center junction 134 includes T-shaped slot 102 having vertical slot portion 104 and horizontal slot portion 106. Center junction 134 includes floor 110 (or ceiling 110). Center junction 134 includes pockets 112, pivot pins 114, sidewalls 116, intermediate section 118, and L-shaped pieces 120 forming slot 122. Center junction 134 includes surface 124, outer plate sections 126, and slot 128. Center junction includes rear portion 130 to the intermediate junction section 118.

FIG. 10A shows the strap apparatus 82 of FIG. 7A. FIG. 10B shows a rear view of upper center junction B. FIG. 10C shows a rear view of lower center junction H.

Center junction 134 is formed of a hard polymer or plastic. One strap or strap apparatus 82 engages upper center junction B and lower center junction H and another strap 82 engages lower center junction E with lower center junction K, just like other straps 82 are paired with corner junctions A, G and C, I and D, J, and F, L.

Each of center junctions 134 and corner junctions 108 engage strap apparatus 82 in the same way. Strap body 99 is turned on edge to engage slot portion 104 and then flexed or bent to a ninety degree position in which it engages slot portion 106. Strap body 99 is turned on edge to engage slot 122 and then flexed or bent to a ninety degrees in which is engages slot 128.

In the position where strap body 99 engages slot portions 104 and slot 128, strap body 99 is disposed within the interior of corner junction 108 or the interior of center junction 134. Further, flat portion 130 of the intermediate junction section 130 is recessed relative to sidewalls 116 so as to further space the strap body 99 from an exterior of the junction 108 or 134.

As shown in FIG. 11, each of the strap ends 96, 98 have respective strap loops 136, 138. Loops 136, 138 permit the female and male buckle ends 90, 92 to be pivotable relative to the strap apparatus 82. FIG. 11 further shows strap body on surface 124, in slot 128, and in slot portion 106.

Figure 12A:
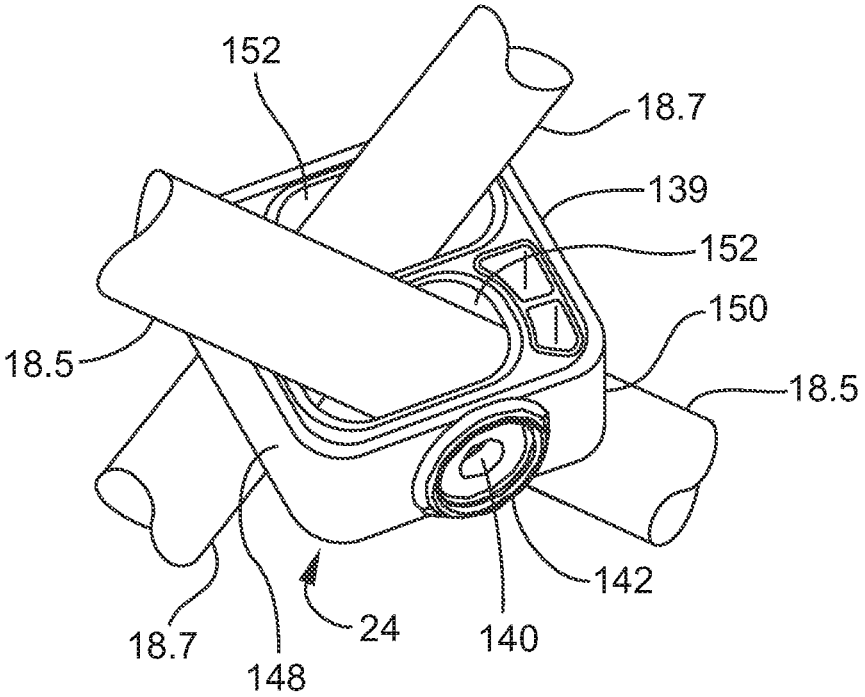
FIG. 12A is a perspective view of an intermediate junction for the frame of FIG. 2 engaging crossing support members of the frame of FIG. 2.
Figure 12B:
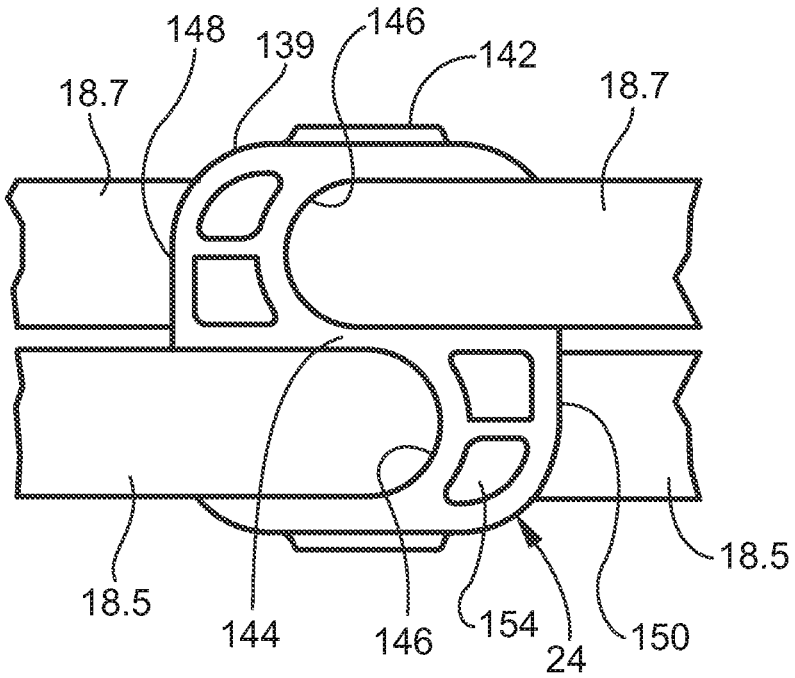
FIG. 12B is a bottom view of the intermediate junction of FIG. 12A.

FIG. 12A shows a perspective view of the intermediate junction 24. FIG. 12B shows a top view of the intermediate junction 24. Intermediate junction 24 is a square plastic piece 139 with rounded corners. A pivot pin 140 is anchored by the plastic piece 139 and engages each of the support members 18 that cross each other at the intermediate junction 24. By way of example, support members 18.5 and 18.7 are illustrated in FIGS. 12A and 12B. Surrounding the head of the pivot pin 140 is a boss 142. Pivot pin 140 extends through the piece 139 from one side of the piece 139 to the other side of the piece 139. Pivot pin 140 may be anchored via bearings in an integral center wall 144 of the piece 139. Piece 139 includes a pair of oblong openings 146 offset from each other. "Oblong" means deviating from a square, circular, or spherical form by elongation in one dimension. Openings 146 are offset relative to each other and are also offset relative to the axis of the pivot pin 140. In other words, one oblong opening 146 includes an end adjacent to one side 148 of the piece 139 while the other oblong opening 146 includes an end adjacent to another side 150 of piece 139. In still other words, a first end of a first oblong opening 146 is closer to the axis of the pivot pin 140 than a second end of such first oblong opening 146. Sides 148, 150 are opposite of each other. Each of the oblong openings 146 are defined by vertical sidewalls 152. The vertical sidewalls 152 are endless. Vertical sidewalls 152 are parallel to sides 148, 150. Piece 139 includes vertically running through openings 154 formed therein. Openings 154 are formed adjacent to the end of the oblong opening 146 that is disposed relatively close to the axis of the pivot pin 140. Openings 154 are not formed adjacent to the end of the oblong opening 146 that is spaced relatively far away from the axis of the pivot pin 140 since such end is relatively close to either side 148 or side 150.

Intermediate junction 24 works as a stop. That is, when frame 12 is completely folded out, a bottom rounded edge section of an end portion of vertical sidewall 152 of first oblong opening 146 confronts the rounded sidewall of the support member 18 at the same time as a top rounded edge section of the opposite portion of vertical sidewall 152 of such first oblong opening 146 confronts the rounded sidewall of the support member 18. The second oblong opening 146 works in a same but opposite manner such that there are two bottom rounded edge sections and two top rounded edge sections of pieces 139 working as a set of four stops at the same time. When frame 12 is in the folded in and compact position, as shown in FIGS. 5A, 5B, and 5C, the rounded sidewalls of the support members 18 are disengaged from and spaced from such two bottom rounded edge sections and such two top rounded edge sections of pieces 139, though support members 18 are still disposed obliquely relative to planes respectively defined by the parallel upper and lower surfaces of piece 139.

Figure 13:
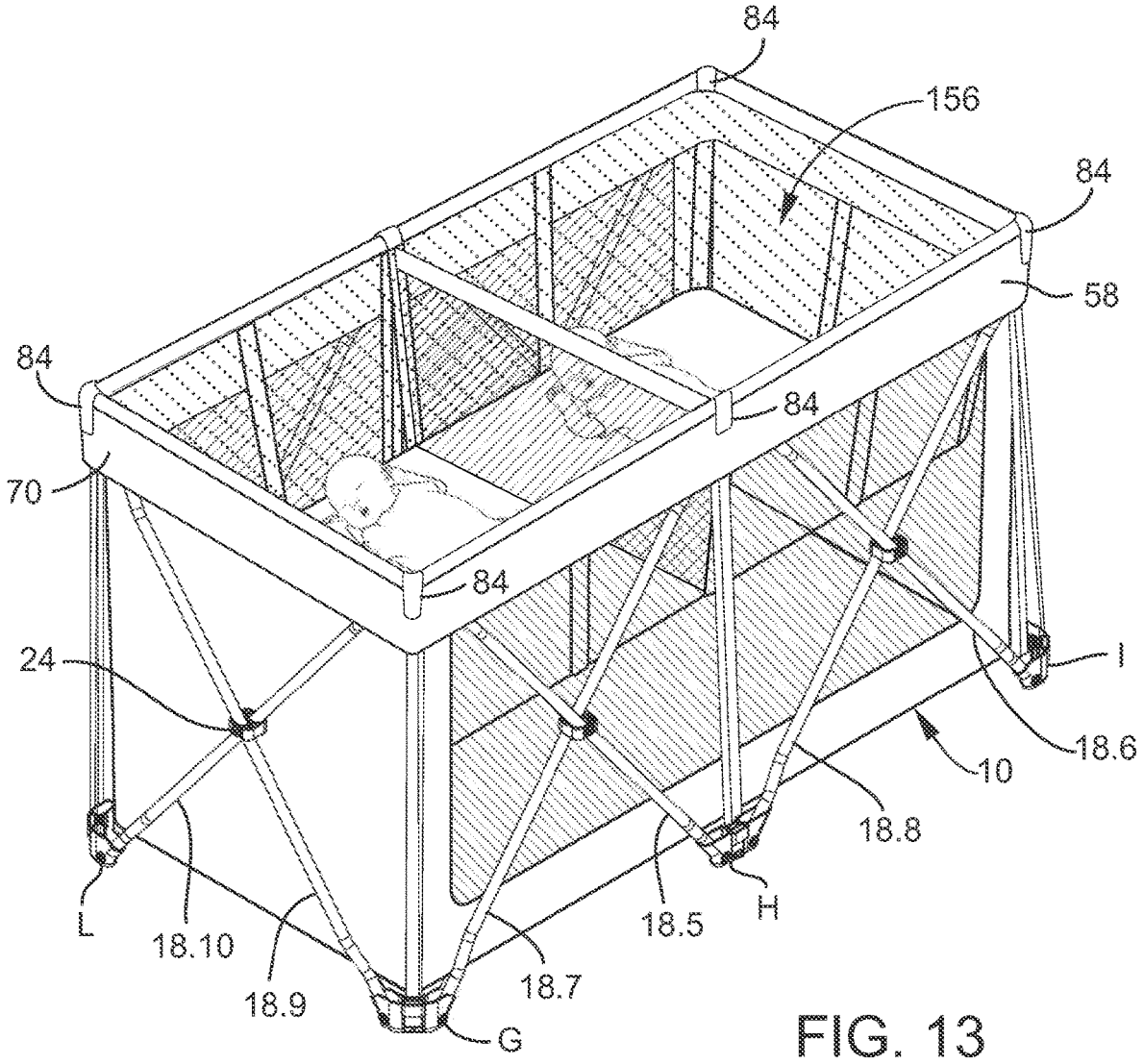
FIG. 13 is a perspective view of a second embodiment of the travel nursery apparatus of the present invention, where the second embodiment includes an infant bassinet engaged with the travel nursery of FIG. 1.

FIG. 13 shows a second embodiment of the travel nursery apparatus 10, where the second embodiment includes an infant bassinet 156 engaged with the travel nursery apparatus 10 of FIG. 1. After the outer walls 58, 64, 70, 76 are folded over the upper junctions A, B, C, D, E, F, the infant bassinet 156 may be engaged to the upper junctions A, B, C, D, E, and F.

Figure 14:
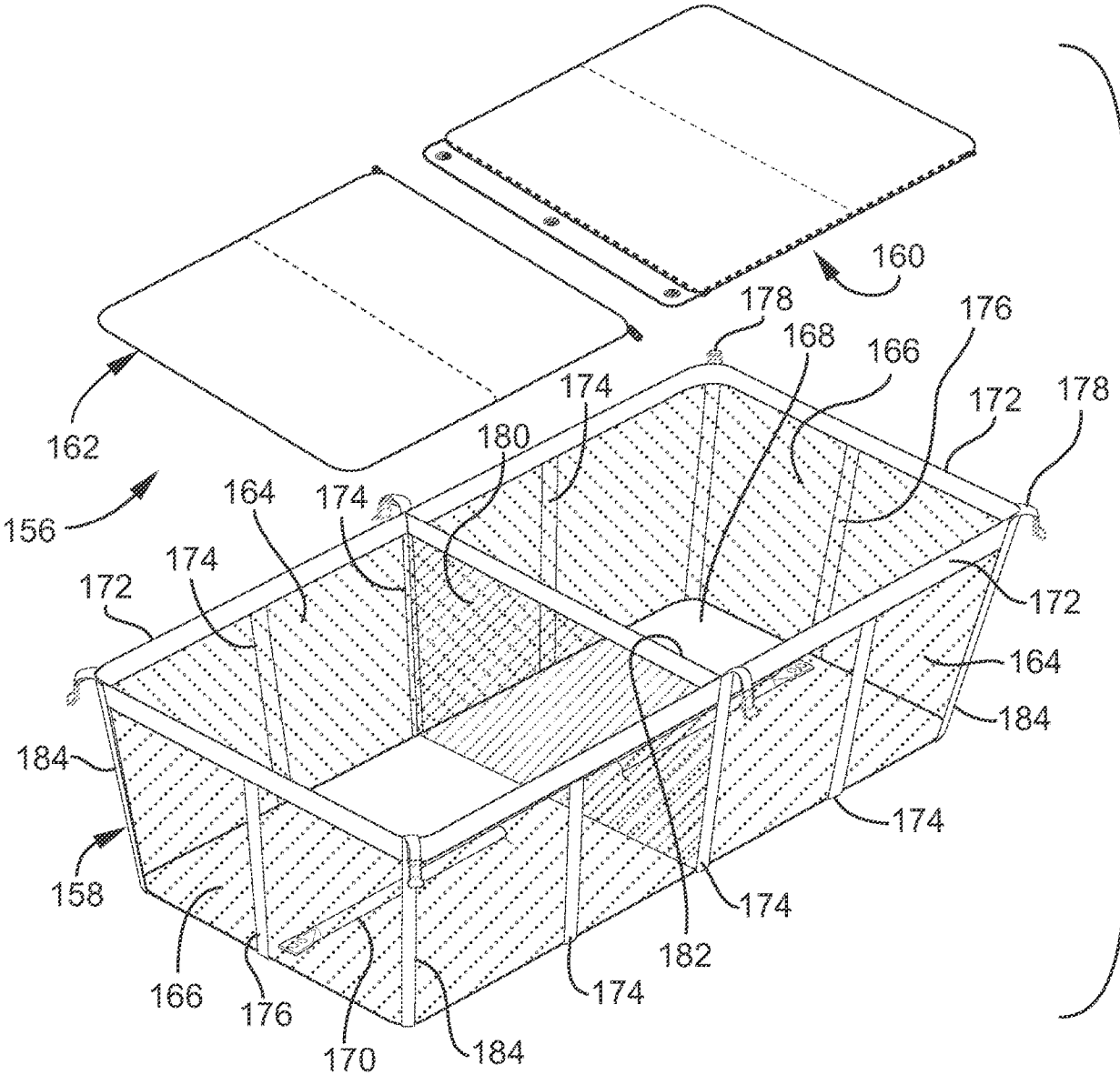
FIG. 14 is an exploded view of the infant bassinet of FIG. 13.

FIG. 14 is an exploded view of the infant bassinet 156. Infant bassinet 156 includes a receptacle 158 and a pair of pads 160, 162 for the bottom of the receptacle.

Receptacle 158 is formed of soft and hard components. Soft components include sidewalls 164 and end walls 166. A floor 168 may be a soft component and include a telescoping tube 170 running longitudinal between the end walls 166.

Floor 168 may be formed of a flexible material such as a fabric or polymer or nylon. Sidewalls 164 and end walls 166 may be formed of a mesh flexible material such as a fabric or polymer or nylon mesh.

The upper edges of sidewalls 164 and end walls 166 include relatively wide strips 172 of a flexible material such as a fabric or polymer or nylon. A set of three relatively wide laterally extending strips 174 of a flexible material such as a fabric or polymer or nylon extend in a U-shaped manner to extend from strip 172 downwardly on sidewall 164, laterally across the under face of floor 168, upwardly on sidewall 164, and terminate on opposite strip 172. Strips 174 may be engaged such as by stitching or by adhesive to sidewalls 164 and floor 168. A single relatively wide longitudinally extending strip 176 of a flexible material such as a fabric or polymer or nylon extends in a U-shaped manner to extend from strip 172 downwardly on end wall 166, longitudinally across the under face of floor 168, upwardly on the other end wall 166, and terminate on opposite strip 172. Strip 176 may be engaged such as by stitching or by adhesive to sidewalls 164 and floor 168.

Hard components of the infant bassinet 156 include the telescoping tube 170 and junction clips 178. There are six junction clips 178, one each for engaging each of the upper junctions A, B, C, D, E, and F. Junction clips 178 are engaged to the upper peripheral edge of the infant bassinet 156, including strip 172. Four junction clips 178 are engaged to the upper corners of the infant bassinet 156. Two junction clips 178 are centrally disposed on the sidewalls 164 between two adjacent bassinet corners.

A further soft component of the infant bassinet 156 is a dividing interior vertical wall 180 formed of a mesh flexible material such as a fabric, polymer, or nylon. Wall 180 includes an upper strip 182 formed of a flexible material such as a fabric, polymer, or nylon. The side and bottom edges of wall 180 may be engaged, such as by stitching, to the middle or central strip 174.

Figure 15A:
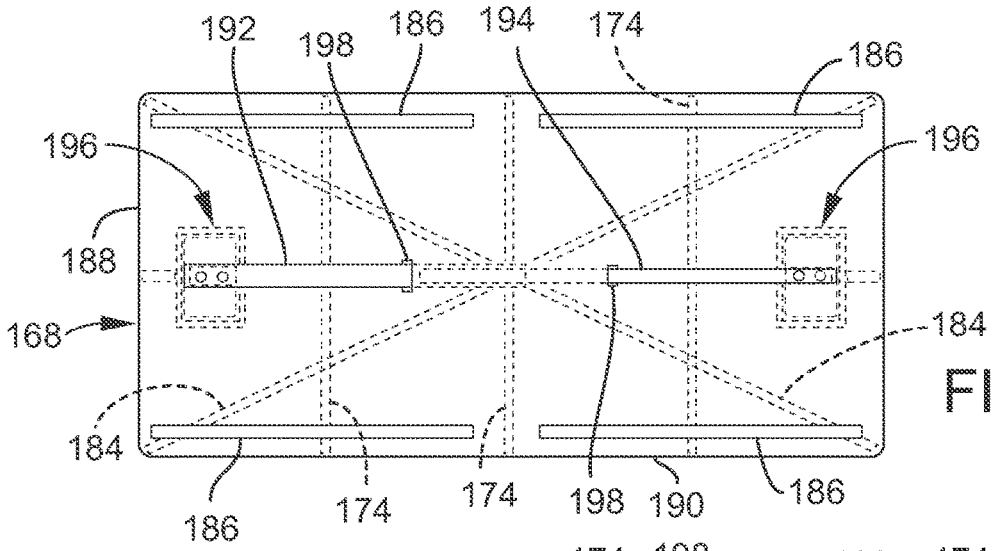
FIG. 15A is a top view of the floor component of the infant bassinet of FIG. 14.

FIG. 15A shows a top view of the floor 168. Strips 174 are shown in phantom since such strips 174 are engaged to the under face of the floor 168. Further shown in phantom are oblique strips 184 formed of a flexible material such as a fabric, polymer, or nylon. One oblique strip 184 runs from corner to corner in a diagonal or catty corner fashion. A second oblique strip 184 runs from corner to corner in a diagonal or catty corner fashion. The diagonal strips 184 cross at the under face of the center of the floor 168. The diagonal strips 184 continue upwardly from the floor 168, up the junctions of side and end walls 164, 166, to terminate at peripheral strip 172.

The upper face of floor 168 includes a set of four flexible strips 186 of quick connect material such as Velcro®. The quick connect material may be include macroscopic hooks and/or loops. Strips 186 are spaced from the end (lateral) edges 188 and side (longitudinal) edges 190 of floor 168. Strips 186 are adjacent to and spaced from side edges 190. The inner ends of strips 186 are spaced from interior wall 180 and the middle strip 174.

FIG. 15A further shows that telescoping tube 170 has at least two telescoping portions 192, 194. Tube portion 192 is of a larger diameter than tube portion 194. Tube portion 194 telescopes into tube portion 192 when, for example, infant bassinet 156 is taken off travel nursery 10 and is to be stored, in which case the soft bassinet 156 will collapse to have a shorter longitudinal length. The distal ends of tube portions 192, 194 are fixed to a connection apparatus 196 engaged to floor 168. Tube 170 passes over and under floor 168 through openings 198. A central portion of tube 170 is disposed adjacent to the under face of floor 168. Distal portions of tube 170 are disposed adjacent to an upper face of floor 168.

Figure 15B:
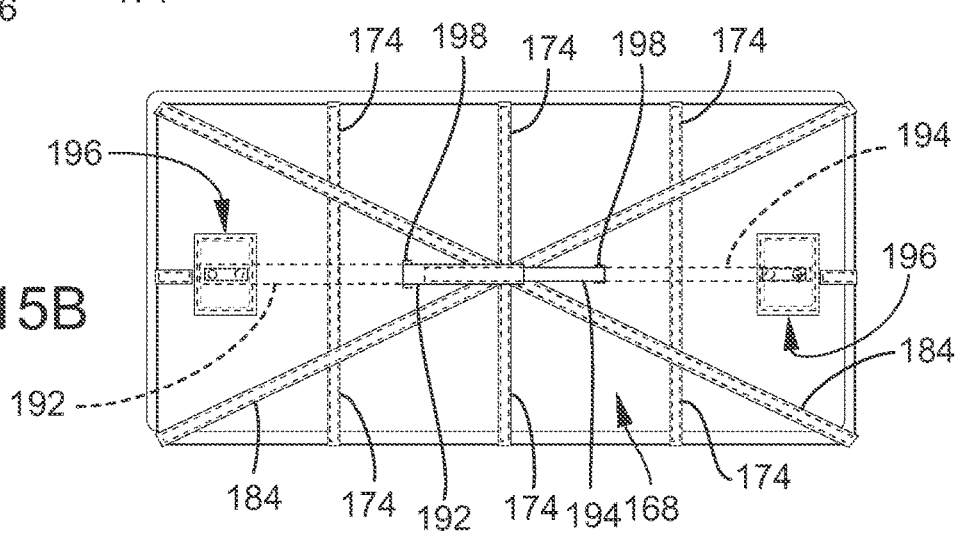
FIG. 15B is a bottom view of the floor component of the infant bassinet of FIG. 14.

FIG. 15B is a bottom view of the floor 168 and shows relatively small diameter tube 194 having been inserted into large diameter tube 192. FIG. 15B further shows the diagonal strips 184, the lateral strips 174, the openings 198, and the connection apparatus 196.

Figure 15C:
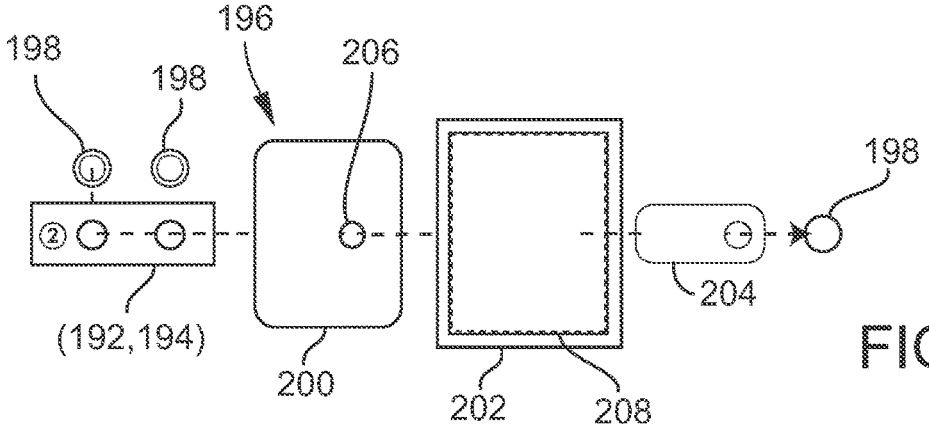
FIG. 15C is an exploded view of a portion of the floor component of FIG. 14.

FIG. 15C is an exploded view of the connection apparatus 196 that connects the ends of tubing 170 to the floor 168 of the infant bassinet 156. The connection apparatus 196 includes rivets 198, a plastic sheet 200, a fabric piece 202, and a rivet cap 204. Plastic sheet 200 is preferably a high-density polyethylene (HDPE). Fabric piece 202 is preferably a waterproof, non-porous, self-extinguishing fabric, where water beads up on such fabric and then rolls off. Fabric piece 202 may be cut from a Cordura® fabric. Fabric piece 202 may be nylon, but may be blended with cotton or other natural fibers.

Plastic sheet 200 lies over the tube end 192 or 194 to transition from a cylindrical surface to a flat surface provided by the hard plastic piece 200. Plastic sheet 200 is preferably thin, such as about 3 mm in thickness. Fabric piece 202 is placed over plastic sheet 200 and stitched to floor 168, thereby holding the plastic sheet 200 in place. Further holding the plastic sheet 200 in place is rivet cap 204 which is placed on the fabric sheet 202 and engages the rivet 198 that passes through opening 206. Rivet cap 204 is engaged to tube end 192 or 194 by one of the rivets 198. Rivet cap 204 pinches the fabric piece 202 between the rivet cap 204 and the plastic piece 200. Stitching 208 immediately inside of the periphery of the fabric piece 202 holds the plastic piece 200 therein. Thus, with the ends 192, 194 of the tubing 170 engaged to the plastic piece 200 that is engaged within the fabric piece 202 that is engaged to the floor 168, the ends of the floor 168 and thus the ends 166 of the infant bassinet 156 can be drawn in when the tubing 170 is retracted so as to minimize the size of the infant bassinet 156 for transport from the factory to a distribution center, for shelf space at the distribution center or in the retail store, for storage at home, or for carrying in the car.

Figure 16A:
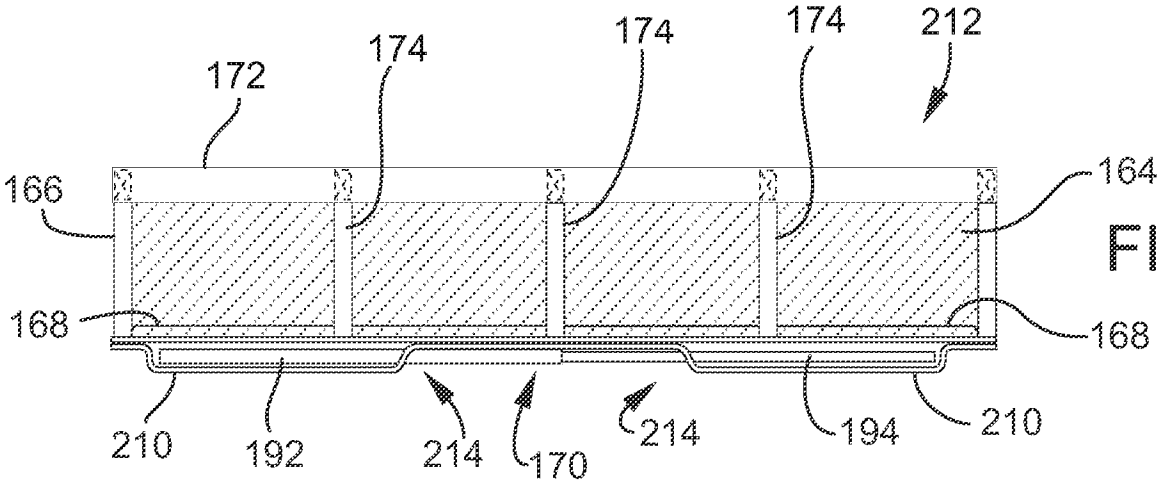
FIG. 16A is a side, partially section, view of an alternate embodiment of the infant bassinet of FIG. 14.
Figure 16B:
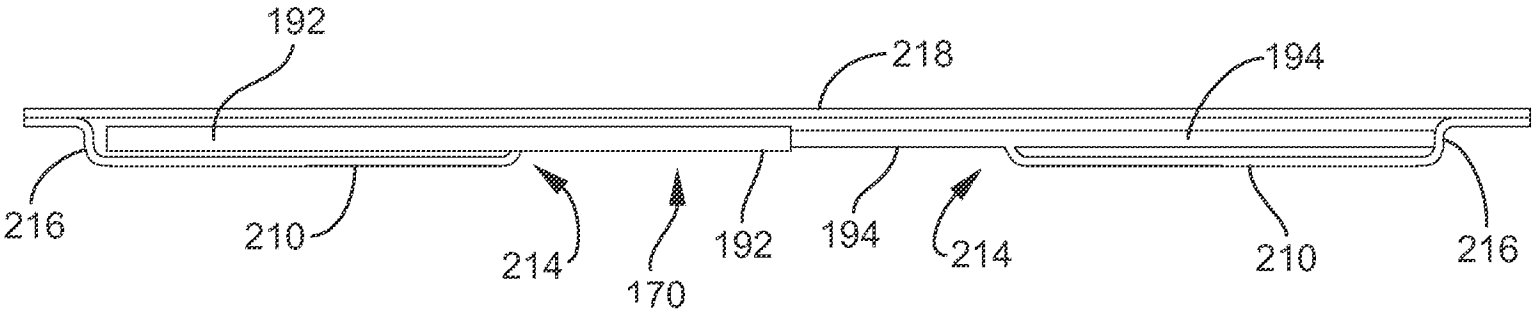
FIG. 16B is a detail section view of pockets of the infant bassinet of FIG. 16A.

As shown in FIG. 15B, the U-shaped straps 174 closest to the ends of the infant bassinet 156 are engaged to the floor 168 under the distal ends of tubes 192, 194, while the center U-shaped strap 174 is engaged to floor 168 above tubing 192 and adjacent to where tubing 194 extends into tubing 192. In contrast, in FIG. 16A, an alternate embodiment of the infant bassinet has all of the U-shaped straps 174 disposed above all portions of tubes 194, 192 and a pair of pockets 210 depending from a platform 218 that depends from floor 168 engage the distal ends of the tubes 194, 192. This embodiment, referred to as infant bassinet 212, has pocket openings 214 on the inner portions of the pockets 210 and closed pocket ends 216. Pockets 210 engage the distal ends of tubing 170.

Pockets 210 are engaged to a flexible platform 218 that is in turn engaged or stitched to floor 168, where floor 168 does not include the connection apparatus 196. Flexible platform is a fabric or polymer or nylon platform.

Like infant bassinet 156, infant bassinet 212 includes a) receptacle 158, b) pads 160, 162, c) sidewalls 164, d) end walls 166, e) floor 168, f) telescoping tube 170, g) the relatively wide strips 172, h) the relatively wide laterally extending strips 174 that extend in a U-shaped manner to extend from strip 172 downwardly on sidewall 164, laterally across the under face of floor 168 and the upper face of platform 218, upwardly on sidewall 164, and terminate on opposite strip 172, i) the single relatively wide longitudinally extending strip 176 that extends in a U-shaped manner from strip 172 downwardly on end wall 166, longitudinally across the under face of floor 168 and upper face of platform 218, upwardly on the other end wall 166, and terminates on opposite strip 172, j) junctions clips 178, k) dividing interior vertical wall 180 with upper strip 182, 1) oblique strips 184, m) the set of four flexible strips 186 of quick connect material such as Velcro®, and m) telescoping tube 170 that has at least two telescoping portions 192, 194 that are removably engaged in the pockets 210.

Figure 17A:
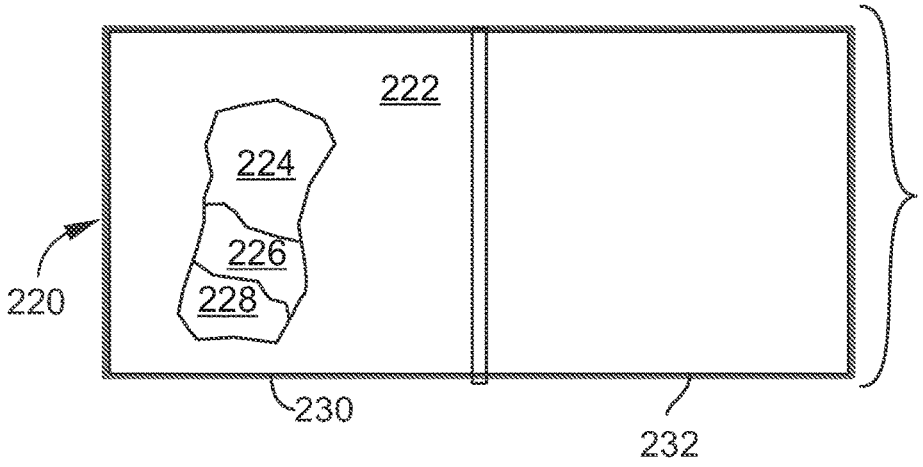
FIG. 17A is a top view of a floor soft component of the infant bassinet of FIG. 14.
Figure 17B:
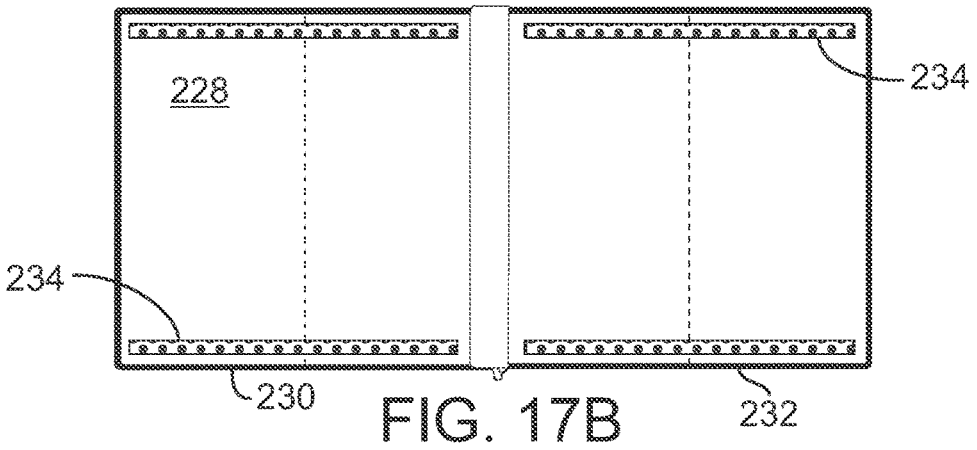
FIG. 17B is a bottom view of the floor soft component of FIG. 17A.
Figure 17C:
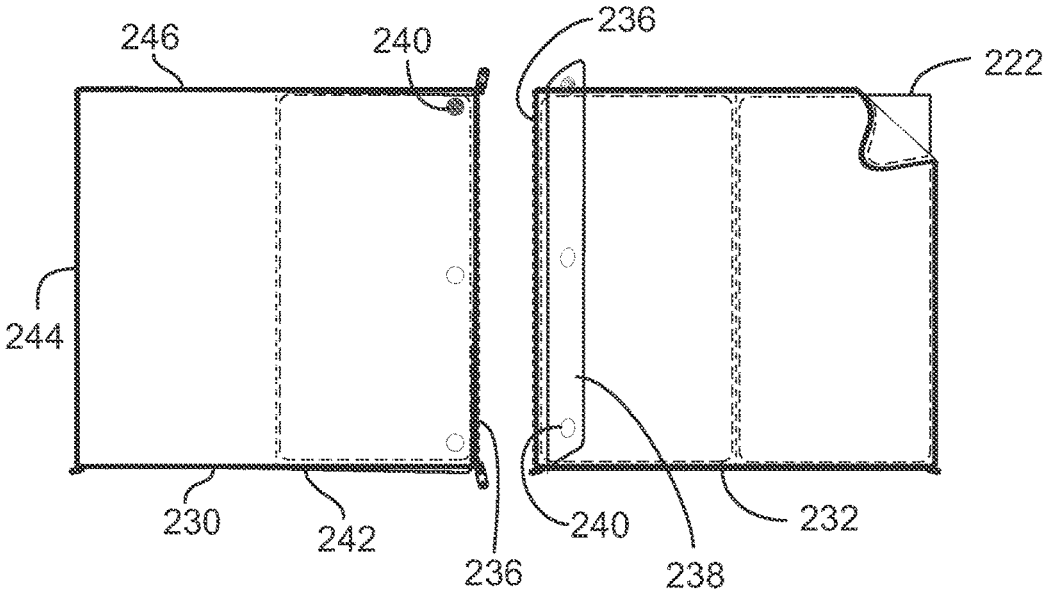
FIG. 17C is a top exploded view of the floor soft component of FIG. 17A.

FIGS. 17A, 17B, and 17C show a folding sleeping mat 220 for being disposed on the top of the floor 168 of either of the infant bassinets 156, 212. Mat 220 includes four layers: 1) a top layer 222 of a light minky plush 100% polyester fabric, 2) a layer 224 immediately under the top layer 222 where layer 224 is a corrugated high density polyethylene board that is about six millimeters thick, 3) a layer 226 immediately under layer 224 where layer 226 is a high density polyurethane foam that is 25 millimeters thick, and 4) layer 228 immediately under layer 226 where layer 228 is a waterproof and wipeable vinyl material. Layer 228 is the bottom layer. Mat 220 includes two half portions 230 and 232. Each of the half portions includes layers 222, 224, 226, and 228. All layers extend substantially to the perimeters of half portions 230, 232.

As shown in FIG. 17B, the underface of the bottom layer 228 includes strips 234 of quick connect material such as Velcro® for connection to quick connectors 186 on the upper surface of floor 168. Strips 234 are adjacent to and spaced from longitudinal edges of the mat 220. Velcro® is a material with macroscopic hooks and loops.

As shown in FIG. 17C the two half portions 230, 232 includes inner edges having a quick connect mechanism 236 such as a zipper mechanism. As further shown in FIG. 17C, an elongate flap 238 is permanently engaged to half portion 232 and removably engaged to half portion 230 with quick connects 240 that are preferably Velcro® quick connects. Velcro® is a material with macroscopic hooks and loops. By engaging quick connects 240 on the underside of flap 238 with the quick connects 240 on the upper face of half portion 230, the elongate quick connect mechanism 236 is hidden.

It should be noted that a portion of the periphery of each of the half portions 230, 232 may be opened and closed with a quick connect such as a zipper mechanism. The periphery portion that may be opened is any of the three straight outer portions 242, 244, 246. Such portion may be opened and closed by a quick connect mechanism such as a zipper mechanism. By opening one of such portions 242, 244, 246, layers 224, 226 may be removed so that layers 222, 228 can be put in a washing machine.

Figure 18C:
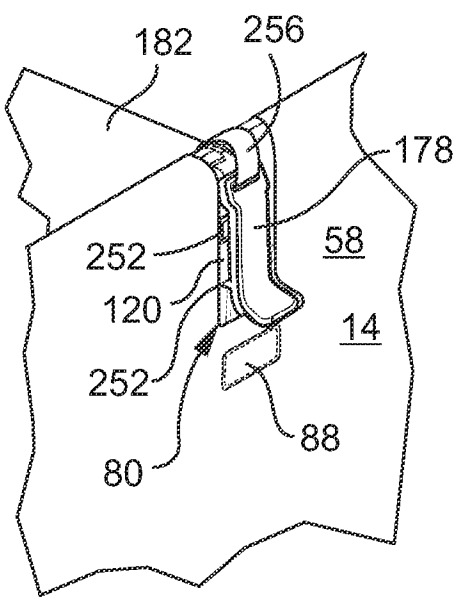
FIG. 18C is a perspective view of the inverted hook of FIG. 18B having engaged the upper side junction of FIG. 18B.
Figure 18B:
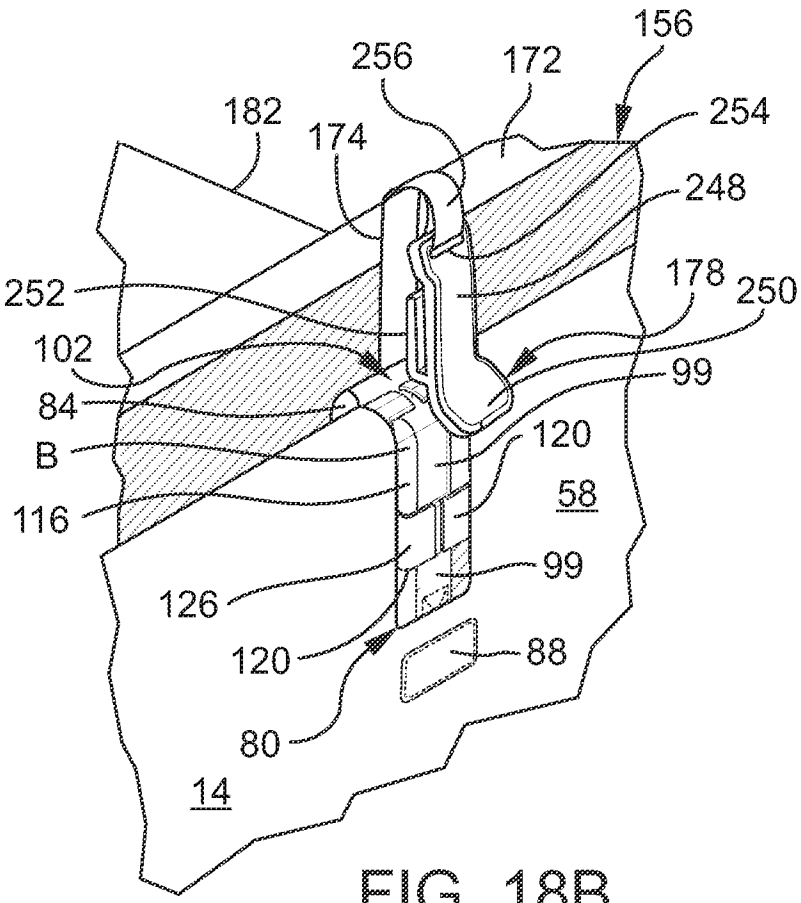
FIG. 18B is a perspective view of an inverted hook of the infant bassinet of FIG. 14 about to engage an upper side junction of the travel nursery apparatus of FIG. 1.
Figure 18A:
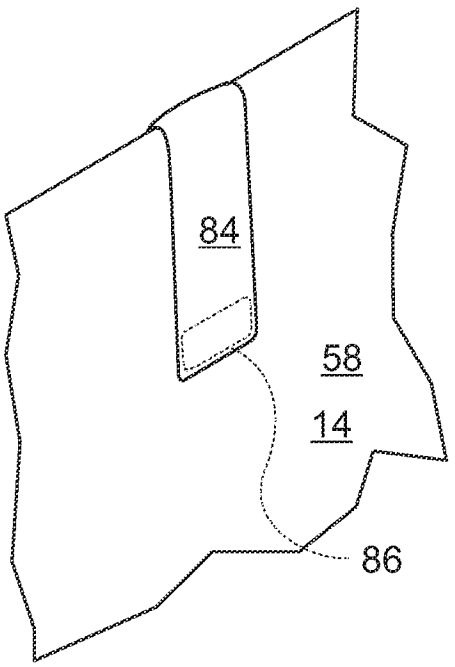
FIG. 18A is a perspective view of a flap portion of the travel nursery apparatus of FIG. 1, where the flap portion covers a portion of an upper side junction of the travel nursery apparatus of FIG. 1.

FIGS. 18A, 18B, 18C, and 19 show the flap 84, the opening 80, and junction clip 178. FIG. 18A shows the flap 84 in a closed state. The closed state is employed when bassinet 156 or 212 is not used.

Figure 19:
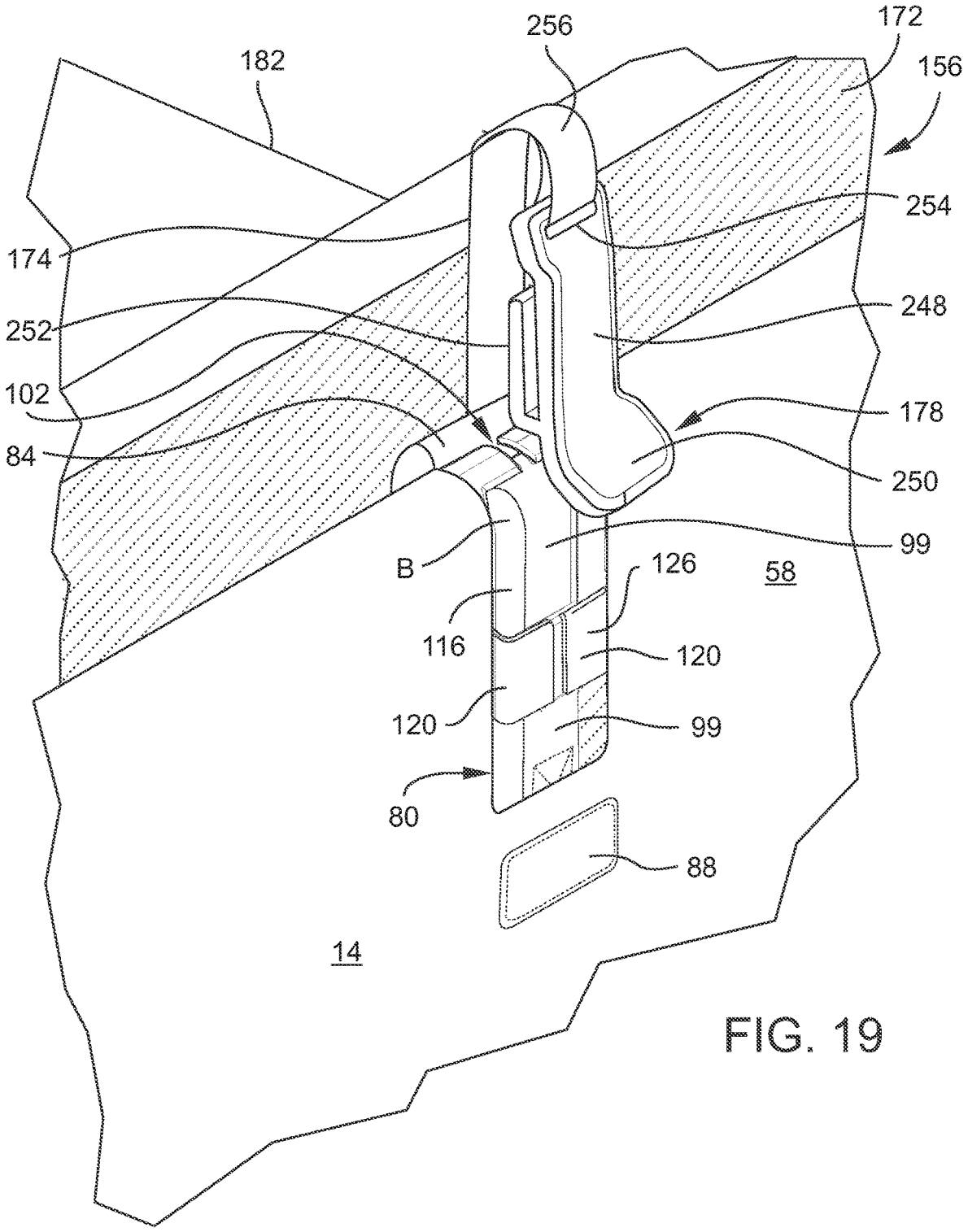
FIG. 19 is a detail view of FIG. 18B.

FIG. 18B shows the flap 84 in an open state to expose the L-shaped pieces 120 of the upper junctions A, B, C, D, E, and F. FIG. 18B shows that the junction clip 178 includes a base 248 having an oblique finger hold 250, an inverted U-shaped connector or clip 252 extending from the back side of the base 248, and a slot 254 for connection of a strap 256. Strap 256 is an extension of strap 174 in the case of a center junction clip 178. In the case of the corner junction clips 178, strap 256 is an extension of the diagonal strip 184. U-shaped connector 252 engages or captures the L-shaped pieces 120 of the upper junctions A, B, C, D, E, and F. The weight of the bassinet 156 or 212 draws the U-shaped connector 252 upwardly and into engagement with the L-shaped pieces 120. To disengage the U-shaped connector 252, the bassinet 156 or 212 is lifted upwardly to provide slack to strap extension 256 such that the junction clip 178 may be slid or drawn downwardly and out of engagement with the L-shaped pieces 120. FIG. 18C shows the flap 80 in the open state and shows the U-shaped connector 252 engaged with the L-shaped pieces 120. FIG. 19 is a detail of FIG. 18B.

Figure 20A:
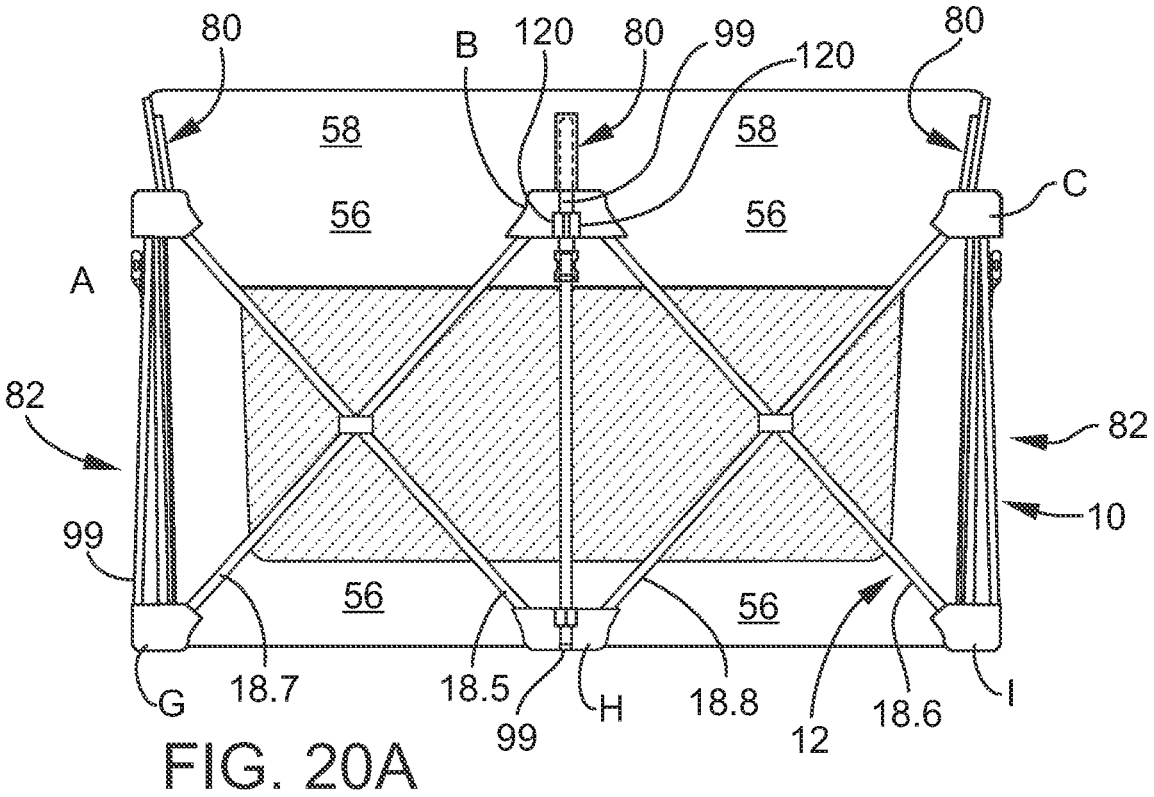
FIG. 20A is a side view of the travel apparatus of Figure, showing a preliminary position of the soft components relative to the frame of FIG. 2.
Figure 20B:
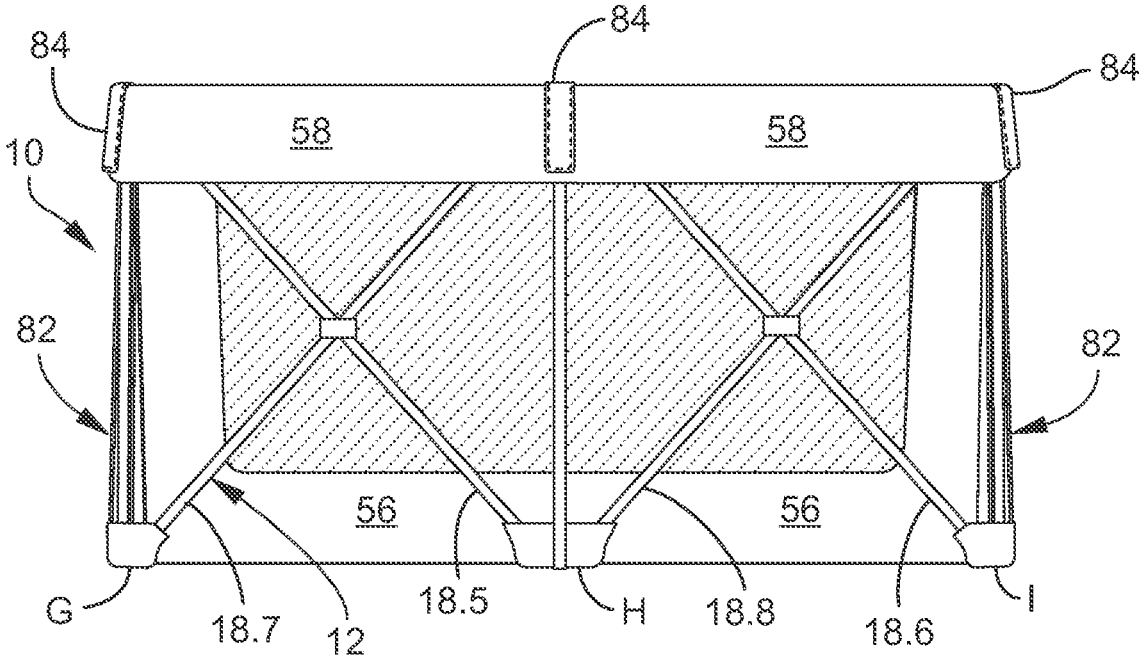
FIG. 20B is a side view of the travel apparatus of FIG. 20A, showing a final position of the soft components relative to the frame of FIG. 2.

FIG. 20A is a side elevation view of the travel nursery apparatus 10 of FIG. 1 with the outer walls 58, 62, 70, and 74 raised. The outer walls 58, 62, 70, and 74 may be lowered prior to or after the frame 12 is folded out. FIG. 20B is a side elevation of the travel nursery apparatus 10 of FIG. 1 after the outer walls 58, 62, 70, and 74 have been folded down over the upper junctions A, B, C, D, E, and F and after the flaps 84 have been engaged to connector pieces 88.

Figure 21:
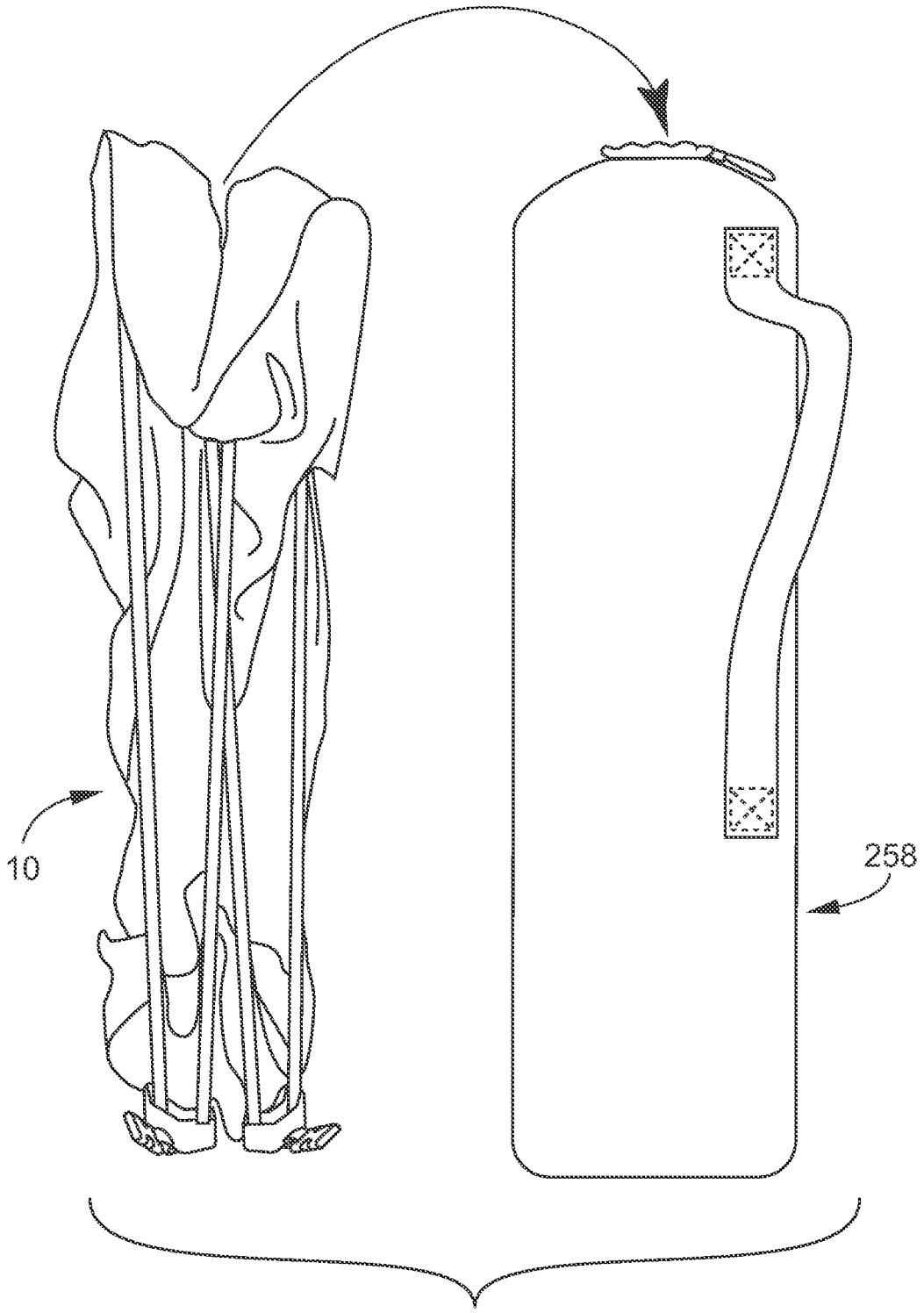
FIG. 21 is a side view of the travel nursery apparatus of FIG. 1 in a collapsed compact form, shown next to a flexible drawstring elongate bag that may hold the collapsed travel nursery apparatus.

FIG. 21 is a side view of the travel nursery apparatus 10 of FIG. 1 in a collapsed compact form, shown next to a flexible drawstring elongate bag 258 that may hold the collapsed travel nursery apparatus 10.

Strap apparatus 82 may be used, but need not be used, where over center lock apparatus 32 is used.

"Parallelepiped" means one or more of the following: 1) a three-dimensional figure formed by six parallelograms, and 2) a structure with six faces, all parallelograms, where the structure is solid or otherwise.

"Rectangle" means a parallelogram all of whose angles are right angles, especially, but not necessarily, one with adjacent sides of unequal length.

"Parallelogram" means a quadrilateral with opposite sides parallel and equal.

"Quadrilateral" means a polygon of four sides.

The set of upper junctions A, B, C, D, E, and F defines each of a rectangle, parallelogram, and quadrilateral. The set of lower junctions G, H, I, J, K, and L defines each of a rectangle, parallelogram, and quadrilateral. The frame 12 defines four sides of a parallelepiped. The frame 12 plus the open top and open bottom of the frame 12 defines all six sides of a parallelepiped. The flexible receptacle 14 defines five sides of a parallelepiped. The flexible receptacle 14 plus the open top of the flexible receptacle defines all six sides of a parallelepiped.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A travel nursery apparatus comprising:

a) a frame;

b) the frame including a set of support members;

c) the frame including upper junctions, lower junctions, and intermediate junctions, the upper junctions and lower junctions being vertically disposed relative to each other, each of the upper, lower, and intermediate junctions pivotally engaging at least two of said support members;

d) the frame including a first pair of support members that cross each other and a second pair of support members that cross each other, the first and second pairs of support members being adjacent to each other, the first and second pairs of support members engaging a common upper junction, the first and second pairs of support members engaging a common lower junction, the first pair of support members crossing at a first intermediate junction, the second pair of support members crossing at a second intermediate junction;

e) a flexible receptacle engaged to the frame and having an outer sidewall portion, an inner sidewall portion, and a floor, the inner sidewall portion disposed inwardly of the frame, the outer sidewall portion disposed outwardly of the frame, the outer sidewall portion and inner sidewall portion of the flexible receptacle being integral and one-piece with each other;

f) the upper junctions defining an upper rectangle and the lower junctions defining a lower rectangle;

g) wherein at least one of said upper junctions is a corner upper junction, the corner upper junction having first and second support member pockets with respective first and second axis, the first and second axis disposed in first and second planes that are disposed at a right angle to each other;

h) wherein at least one of said lower junctions is a corner lower junction, the corner lower junction having first and second support member pockets with respective first and second axis, the first and second axis disposed in first and second planes that are disposed at a right angle to each other;

i) wherein end portions of the support members in the first and second support member pockets of said corner upper junction are swingable on pins back and forth in said pockets; and j) wherein end portions of the support members in the first and second support member pockets of said corner lower junction are swingable on pins back and forth in said pockets.

2. The travel nursery apparatus of claim 1, wherein the inner sidewall portion and the floor of the flexible receptacle define five faces of a parallelepiped.

3. The travel nursery apparatus of claim 1, wherein the support members define a first train and a second train, the first train including at least six support members, at least three upper junctions, and at least three lower junctions, the second train including at least six support members different from that included in the first train, at least three upper junctions different from that included in the first train, and at least three lower junctions different from that included in the first train, the first train weaving into and out of the second train.

4. The travel nursery apparatus of claim 1, wherein each of the support members includes a straight portion, wherein the first pair of support members includes an upwardly extending support member that extends from a lower junction G to an upper junction B, wherein the second pair of support members includes an upwardly extending support member that extends from a lower junction H to an upper junction C, wherein said straight portions of the upwardly extending support members are disposed in a common plane.

5. The travel nursery apparatus of claim 4, wherein the first pair of support members includes a downwardly extending support member that extends from an upper junction A to a lower junction H, wherein the second pair of support members includes a downwardly extending support member that extends from upper junction B to a lower junction I, wherein the said straight portions of said downwardly extending support members are disposed in a common plane.

6. The travel nursery apparatus of claim 1, wherein the frame further includes a third pair of support members that cross each other and a fourth pair of support members that cross each other, the third and fourth pair of support members being adjacent to each other, the third and fourth pairs of support members engaging a common upper junction, the third and fourth pairs of support members engaging a common lower junction, the third pair of support members crossing at a third intermediate junction, the fourth pair of support members crossing at a fourth intermediate junction, the third and fourth pairs of support members facing the first and second pairs of support members.

7. The travel nursery apparatus of claim 1, wherein the frame further includes a fifth pair of support members that cross each other, the fifth pair of support members sharing upper junctions with the first and third pairs of support members, the fifth pair of support members sharing lower junctions with the first and third pairs of support members.

8. The travel nursery apparatus of claim 1, wherein the frame further includes a sixth pair of support members that cross each other, the sixth pair of support members sharing upper junctions with the second and fourth pairs of support members, the sixth pair of support members sharing lower junctions with the second and fourth pairs of support members.

9. The travel nursery apparatus of claim 1, wherein the intermediate junction comprises a pin engaging crossing support members.

10. The travel nursery apparatus of claim 1, wherein the intermediate junction comprises a piece having first and second through openings, a first support member extending through the first through opening and being pivotally engaged to the piece, a second support member extending through the second through opening and being pivotally engaged to the piece, each of the first and second through opening being oblong in shape, the first and second through opening being offset from each other, each of the first and second through openings having opposing ends, each of the opposing ends having upper and lower portions, the first support member engaging a lower portion of one opposing end and an upper portion of the other opposing end of the first through opening when the frame has been scissored completely out to provide stops for such scissoring, the second support member engaging a lower portion of one opposing end and an upper portion of the other opposing end of the second through opening when the frame has been scissored completely out to provide stops for such scissoring.

11. The travel nursery apparatus of claim 1, and further comprising a bassinet apparatus engaged to upper junctions of the frame of the travel nursery apparatus, the bassinet apparatus depending into the flexible receptacle, the bassinet apparatus having a floor that is spaced from the floor of the flexible receptacle.

12. The travel nursery apparatus of claim 1, and further comprising a bassinet apparatus engaged to upper junctions of the frame of the travel nursery apparatus, the bassinet apparatus depending into the flexible receptacle, the bassinet apparatus having a floor that is spaced from the floor of the flexible receptacle, wherein said upper junctions include four corner upper junctions.

13. The travel nursery apparatus of claim 1, and further comprising a bassinet apparatus engaged to upper junctions of the frame of the travel nursery apparatus, the bassinet apparatus depending into the flexible receptacle, the bassinet apparatus having a floor that is spaced from the floor of the flexible receptacle, wherein said upper junctions include four corner upper junctions and two side upper junctions, and wherein each of the side upper junctions is disposed between two of the corner upper junctions.

14. The travel nursery apparatus of claim 1, wherein the first and second support member pockets of said corner upper junction are disposed at a right angle relative to each other, and wherein the first and second support member pockets of said corner lower junction are disposed at a right angle relative to each other.

15. A travel nursery apparatus comprising:

a) a frame;

b) the frame including a set of support members;

c) the frame including upper junctions, lower junctions, and intermediate junctions, the upper junctions and lower junctions being vertically disposed relative to each other, each of the upper, lower, and intermediate junctions pivotally engaging at least two of said support members;

d) the frame including a first pair of support members that cross each other and a second pair of support members that cross each other, the first and second pairs of support members being adjacent to each other, the first and second pairs of support members engaging a common upper junction, the first and second pairs of support members engaging a common lower junction, the first pair of support members crossing at a first intermediate junction, the second pair of support members crossing at a second intermediate junction;

e) a flexible receptacle engaged to the frame and having an outer sidewall portion, an inner sidewall portion, and a floor, the inner sidewall portion disposed inwardly of the frame, the outer sidewall portion disposed outwardly of the frame, the outer sidewall portion and inner sidewall portion of the flexible receptacle being integral and one-piece with each other;

f) the upper junctions defining an upper rectangle and the lower junctions defining a lower rectangle;

g) wherein at least one of said upper junctions is a corner upper junction, the corner upper junction having first and second support member pockets with respective first and second axis, the first and second axis disposed in first and second planes that are disposed at a right angle to each other;

h) wherein at least one of said lower junctions is a corner lower junction, the corner lower junction having first and second support member pockets with respective first and second axis, the first and second axis disposed in first and second planes that are disposed at a right angle to each other;

i) wherein a first corner upper junction includes first and second upper pockets, the first upper pocket having a first support member with an end portion that is swingable in the first upper pocket, the second upper pocket having a second support member with an end portion that is swingable in the second upper pocket; and j) wherein a first corner lower junction includes first and second lower pockets, the first lower pocket having a first support member with an end portion that is swingable in the first lower pocket, the second lower pocket having a second support member with an end portion that is swingable in the second lower pocket.

16. The travel nursery apparatus of claim 15, wherein the first and second support member pockets of said corner upper junction are disposed at a right angle relative to each other, and wherein the first and second support member pockets of said corner lower junction are disposed at a right angle relative to each other.

17. A travel nursery apparatus comprising:

a) a frame;

b) the frame including a set of support members;

c) the frame including upper junctions, lower junctions, and intermediate junctions, the upper junctions and lower junctions being vertically disposed relative to each other, each of the upper, lower, and intermediate junctions pivotally engaging at least two of said support members;

d) the frame including a first pair of support members that cross each other and a second pair of support members that cross each other, the first and second pairs of support members being adjacent to each other, the first and second pairs of support members engaging a common upper junction, the first and second pairs of support members engaging a common lower junction, the first pair of support members crossing at a first intermediate junction, the second pair of support members crossing at a second intermediate junction;

e) a flexible receptacle engaged to the frame and having an outer sidewall portion, an inner sidewall portion, and a floor, the inner sidewall portion disposed inwardly of the frame, the outer sidewall portion disposed outwardly of the frame, the outer sidewall portion and inner sidewall portion of the flexible receptacle being integral and one-piece with each other;

f) the upper junctions defining an upper rectangle and the lower junctions defining a lower rectangle;

g) wherein at least one of said upper junctions is a corner upper junction, the corner upper junction having first and second support member pockets with respective first and second axis, the first and second axis disposed in first and second planes that are disposed at a right angle to each other;

h) wherein at least one of said lower junctions is a corner lower junction, the corner lower junction having first and second support member pockets with respective first and second axis, the first and second axis disposed in first and second planes that are disposed at a right angle to each other;

i) wherein a first corner upper junction includes first and second upper pockets, the first upper pocket having a first support member with an end portion that is swingable in the first upper pocket, the second upper pocket having a second support member with an end portion that is swingable in the second upper pocket;

j) wherein a first corner lower junction includes first and second lower pockets, the first lower pocket having a first support member with an end portion that is swingable in the first lower pocket, the second lower pocket having a second support member with an end portion that is swingable in the second lower pocket;

k) the end portion of the first support member in the first upper pocket swinging on a pin anchored by sidewalls of said first upper pocket, the end portion of the second support member in the second upper pocket swinging on a pin anchored by sidewalls of said second upper pocket; and l) the end portion of the first support member in the first lower pocket swinging on a pin anchored by sidewalls of said first lower pocket, the end portion of the second support member in the second lower pocket swinging on a pin anchored by sidewalls of said second lower pocket.

18. The travel nursery apparatus of claim 17, wherein the first and second support member pockets of said corner upper junction are disposed at a right angle relative to each other, and wherein the first and second support member pockets of said corner lower junction are disposed at a right angle relative to each other.

* * * * *